US007760160B2

(12) United States Patent
Han

(10) Patent No.: US 7,760,160 B2
(45) Date of Patent: Jul. 20, 2010

(54) PLASMA DISPLAY APPARATUS AND DRIVING METHOD THEREOF

(75) Inventor: Jung Gwan Han, Gumi-si (KR)

(73) Assignee: LG Electronics Inc., Seoul (KR)

( * ) Notice: Subject to any disclaimer, the term of this patent is extended or adjusted under 35 U.S.C. 154(b) by 1233 days.

(21) Appl. No.: 11/325,333

(22) Filed: Jan. 5, 2006

(65) Prior Publication Data

US 2006/0170620 A1 Aug. 3, 2006

(30) Foreign Application Priority Data

Jan. 6, 2005 (KR) ..... 10-2005-0001401

(51) Int. Cl.
*G09G 3/28* (2006.01)

(52) U.S. Cl. ..... 345/60; 345/208; 345/210; 345/63; 345/67; 315/169.4

(58) Field of Classification Search ..... 345/76–82, 345/83–100, 204, 211, 214, 208–210, 60–63, 345/67–68; 315/169.1, 169.3, 169.4
See application file for complete search history.

(56) References Cited

U.S. PATENT DOCUMENTS 6,492,776 B2 * 12/2002 Rutherford ..... 315/169.1
2002/0158822 A1 * 10/2002 Ishizuka et al. ..... 345/63
2003/0098822 A1 * 5/2003 Park et al. ..... 345/60
2003/0107532 A1 6/2003 Choi
2004/0021657 A1 * 2/2004 Kang et al. ..... 345/204
2004/0085305 A1 * 5/2004 Kunii et al. ..... 345/204
2004/0100425 A1 * 5/2004 Kang et al. ..... 345/68
2007/0040767 A1 * 2/2007 Shim et al. ..... 345/68

FOREIGN PATENT DOCUMENTS

CN 1445741 10/2003
CN 1447960 10/2003

OTHER PUBLICATIONS

Chinese Office Action dated Nov. 9, 2007 (including English-language translation).
Taiwanese Office Action dated Jun. 30, 2009 and English-language translation.

* cited by examiner

*Primary Examiner*—Lun-Yi Lao
*Assistant Examiner*—Gregory J Tryder
(74) *Attorney, Agent, or Firm*—KED & Associates, LLP

(57) ABSTRACT

Embodiments of the present invention may relate to a plasma display apparatus and a driving method thereof, to reduce the magnitude of noise. The driving method may include applying a ramp-down waveform decreasing to a first voltage to a plurality of scan electrodes, applying a ramp-up waveform increasing from the first voltage to a second voltage gradually with a gradient to the scan electrodes, and applying a scan pulse decreasing from the second voltage to a third voltage to the scan electrodes.

31 Claims, 17 Drawing Sheets

PLASMA DISPLAY APPARATUS AND DRIVING METHOD THEREOF

This nonprovisional application claims priority under 35 U.S.C. §119(a) from Patent Application No. 10-2005-0001401 filed in Korea on Jan. 6, 2005, the entire contents of which are hereby incorporated by reference.

BACKGROUND OF THE INVENTION

1. Field of the Invention

Embodiments of the present invention relate to a plasma display panel. More particularly, embodiments of the present invention relate to a plasma display apparatus and a driving method thereof, wherein a voltage of a waveform applied to a scan electrode in an address period is controlled to reduce noise.

2. Background Art

In a plasma display panel, a unit cell may be defined by barrier ribs disposed between a front substrate and a rear substrate. Each cell may be filled with a main discharge gas such as neon Ne, helium He and a gas mixture of Ne and He, and an inert gas containing a small amount of xenon Xe. When the gas is discharged due to a high frequency voltage, the inert gas generates vacuum ultra-violet rays, so that the rays excite and radiate fluorescent material existing between the barrier ribs, thereby displaying an image. Since the plasma display panel can be implemented in a thin and light structure, it has been in the limelight as the next generation display apparatus.

SUMMARY OF THE INVENTION

Accordingly, an object of the present invention may be to solve at least problems and disadvantages of background art.

An object of the present invention may be to provide the plasma display apparatus and a driving method thereof, wherein noise generated in a driving waveform applied to scan electrodes in an address period is reduced so that electrical damage of an element in a plasma display panel may be prevented.

A driving method according to one embodiment of the present invention may include applying a ramp-down waveform to a plurality of scan electrodes. The ramp-down waveform may decrease to a first voltage. The method may also include applying a ramp-up waveform increasing from the first voltage to a second voltage with a predetermined gradient. Additionally, a scan pulse may be applied to the scan electrodes. The scan pulse may decrease from the second voltage to a third voltage.

The gradient of the ramp-up waveform may be more gentle than the gradient of a sustain pulse applied in a sustain period.

The ramp-up waveform may be maintained at the second voltage for a predetermined time.

The ramp-up waveform may be continuously applied until a first scan pulse among the scan pulses to be applied to the scan electrodes begins to be applied.

A time for applying the ramp-up waveform (i.e., an applying time) may be longer than 0 microseconds but not beyond 20 microseconds.

The time for applying the ramp-up waveform may range from 6 microseconds to 10 microseconds.

Additionally, the first voltage and the third voltage may be identical to each other or substantially identical to each other.

An applying time of a ramp-up waveform applied to at least one scan electrode may be different from an applying time of a ramp-up waveform applied to at least one of the other electrodes.

The scan electrodes may be divided into two or more scan electrode groups, each group having at least one scan electrode. An applying time of a ramp-up waveform applied to at least one scan electrode group may be different from an applying time of a ramp-up waveform applied to at least one of the other scan electrode groups.

Two or more scan electrode groups may include the same number of scan electrodes.

At least one scan electrode group may have a different number of scan electrodes from that of the other scan electrode groups.

All the scan electrodes belonging to the same scan electrode group may be applied with the ramp-up waveform with an identical applying time.

Time differences between two different applying times may be identical or different.

A plasma display apparatus may be provided that includes a plasma display panel provided with a plurality of scan electrodes. A scan driver may be provided for applying a ramp-down waveform to the scan electrodes decreasing to a first voltage, applying a ramp-up waveform increasing from the first voltage to a second voltage with a predetermined gradient, and applying a scan pulse decreasing from the second voltage to a third voltage.

The gradient of the ramp-up waveform may be more gentle than a gradient of a sustain pulse applied in a sustain period.

The ramp-up waveform may be maintained for a predetermined period at the second voltage.

The ramp-up waveform may be applied until a first scan pulse among scan pulses is applied to the scan electrode.

An applying time of the ramp-up waveform may be longer than 0 microseconds and not beyond 20 microseconds.

The applying time of the ramp-up waveform may range from 6 to 10 microseconds.

The first voltage may be identical to the third voltage.

An applying time of the ramp-up waveform applied to one or more scan electrodes may be different from an applying time of the ramp-up waveform applied to the other scan electrodes.

The scan electrodes may be divided into two or more scan electrode groups and an applying time of the ramp-up waveform applied to one or more scan electrode groups may be different from an applying time of the ramp-up waveform applied to the other scan electrode groups.

Each of the scan electrode groups may include the same number of scan electrodes.

One or more scan electrode group may have a different number of scan electrodes from the other scan electrode groups.

All the scan electrodes belonging to the identical scan electrode group may be applied with the ramp-up waveforms with a same applying time.

Time differences between two different applying times of the ramp-up waveforms applied to two more scan electrode groups may be identical or different.

A plasma display apparatus may be provided that includes a plasma display panel provided with a plurality of scan electrodes and a scan driver for applying a scan reference waveform with a rising period to the scan electrodes.

The scan reference waveform may be a voltage applied in an address period.

The rising period may be a period that a voltage of the scan reference waveform changes with a predetermined gradient to a scan reference voltage.

A plasma display apparatus may be provided that includes a plasma display panel provided with a plurality of scan electrodes; and a scan driver for applying a ramp-down waveform to the scan electrodes decreasing to a first voltage, applying a ramp-up waveform increasing from the first voltage to a second voltage with a predetermined gradient, and applying a scan pulse decreasing from the second voltage to a third voltage. A gradient of the ramp-up waveform may be more gentle than a gradient of a sustain pulse applied in a sustain period.

Other objects, advantages and salient features of embodiments of the present invention will become more apparent from the following detailed description taken in conjunction with the annexed drawings, which disclose embodiments of the invention.

BRIEF DESCRIPTION OF THE DRAWINGS

Arrangements and embodiments of the present invention will be described in detail with reference to the following drawings in which like numerals refer to like elements and wherein.

DETAILED DESCRIPTION OF PREFERRED EMBODIMENTS

Arrangements and preferred embodiments of the present invention will be described in a more detailed manner with reference to the drawings.

Figure 1:
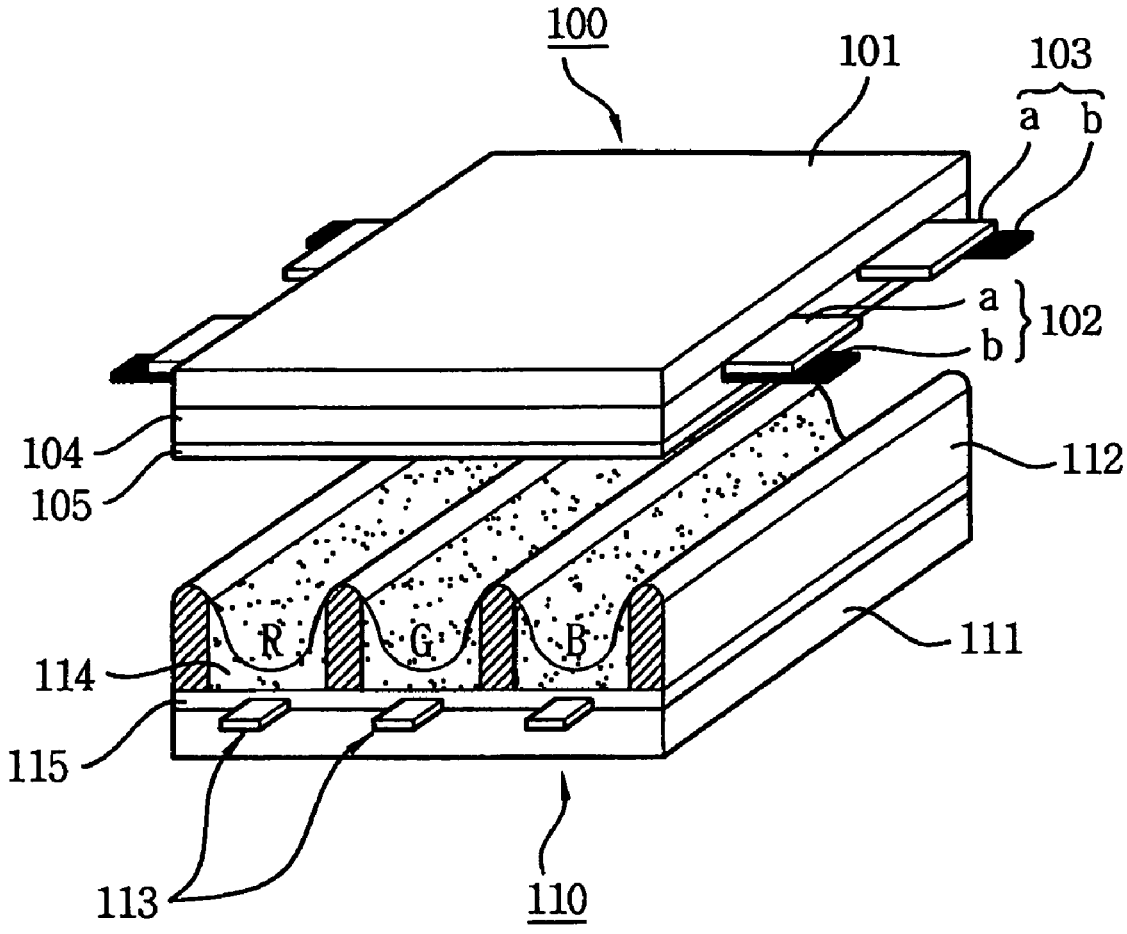
FIG. 1 is a schematic view illustrating a structure of a plasma display panel according to an example arrangement.

FIG. 1 illustrates a schematic view showing a structure of a plasma display panel according to an example arrangement. Other arrangements are also possible.

FIG. 1 shows that a plasma display panel may have a front panel 100 and a rear panel 110 disposed apart and in parallel from each other by a distance. The front panel 100 includes a front substrate 101 serving as a displaying surface, scan electrodes 102 and sustain electrodes 103 arranged on the front substrate 101 by being in pairs called sustain electrode pairs. The rear panel 110 includes a rear substrate 111 providing a rear surface of the plasma display panel and address electrodes 113 arranged on the rear substrate 111 to intersect the sustain electrode pairs.

The front panel 100 includes a plurality of pairs of sustain electrodes, in which each pair is composed of a scan electrode 102 and a sustain electrode 103 for discharging mutually and sustaining radiation in a cell. Each of the scan electrodes 102 and sustain electrodes 103 is composed of a transparent electrode "a" made of indium tin oxide (ITO) and a bus electrode "b" made of a metal, the electrodes "a" and "b" being in a pair. The scan electrodes 102 and the sustain electrodes 103 are coated with one or more upper dielectric layers 104 that limit a discharge current and insulate the pairs of electrodes "a" and "b" from each other pairs. Further, a protection layer 105 may be formed on the top surface of the upper dielectric layer 104 to ease a discharge condition.

On the rear panel 110, stripe type (or well type) barrier ribs 112 may be arranged in parallel to form a plurality of discharge spaces (i.e., discharge cells). Further, a plurality of address electrodes 113 for generating vacuum ultraviolet rays by address discharge may be arranged in parallel with the barrier ribs 112. Still further, R, G, B fluorescent substances 114 for emitting visible light rays upon address discharge are coated over the upper surface of the rear panel 110. A lower dielectric layer 115 is provided between the address electrodes 113 and the fluorescent substances 114 to protect the address electrodes 113. In such a plasma display panel, a method of representing gray levels of an image is shown in FIG. 2.

Figure 2:
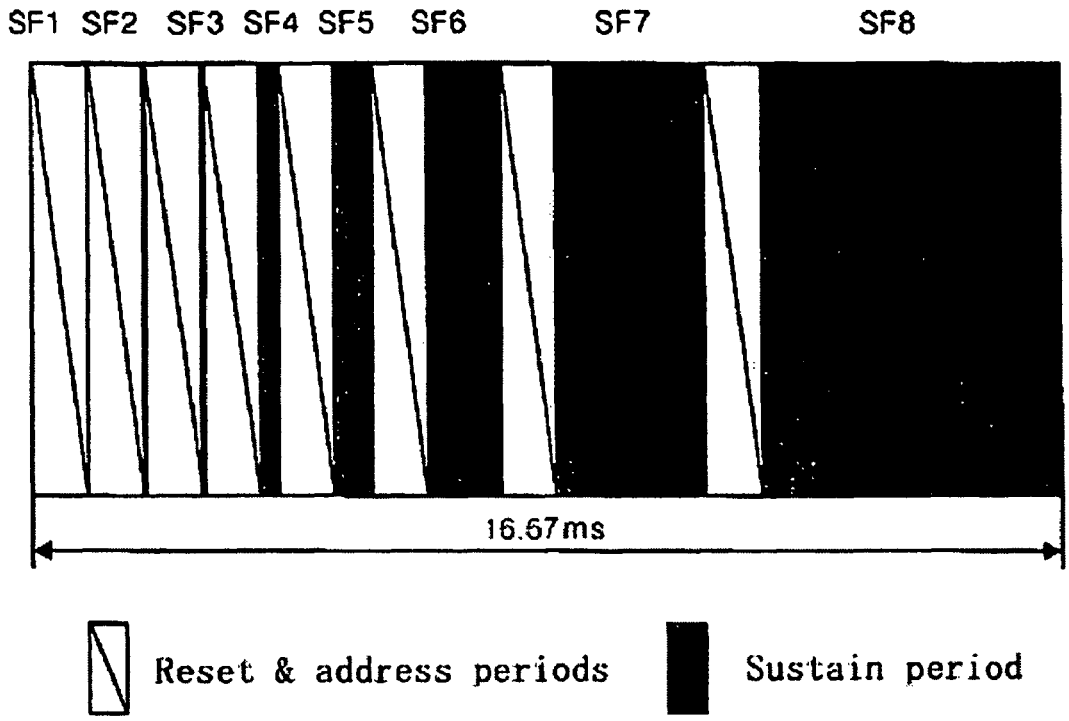
FIG. 2 illustrates a method of representing gray levels of an image according to an example arrangement.

FIG. 2 illustrates a method of representing gray levels of an image according to an example arrangement. Other arrangements are also possible. More specifically, FIG. 2 shows a method of representing gray levels of an image in which a frame period is divided into a plurality of sub-fields with different discharge frequencies, and each sub-field is further divided into a reset period RPD for initializing all cells, an address period APD for selecting cells to be discharged, and a sustain period SPD for representing gray levels according to the discharge frequencies. For instance, in case of displaying an image with 256 gray levels, a frame period (16.67 ms) corresponding to 1/60 second is divided into eight subfields SF1 to SF8.

The length (i.e., a time) of the reset period and the address period may be identical for every sub-field. An address discharge for selecting cells to be discharged may occur due to a voltage difference between the address electrode and the scan electrode, which is a transparent electrode. The sustain period may increase at the rate of $2^n$(n=0, 1, 2, 3, 4, 5, 6, and 7) in each subfield. Since the sustain periods in the subfields are different, the gray levels of the image can be represented by controlling the sustain period (i.e., by controlling the number of discharges).

Figure 3:
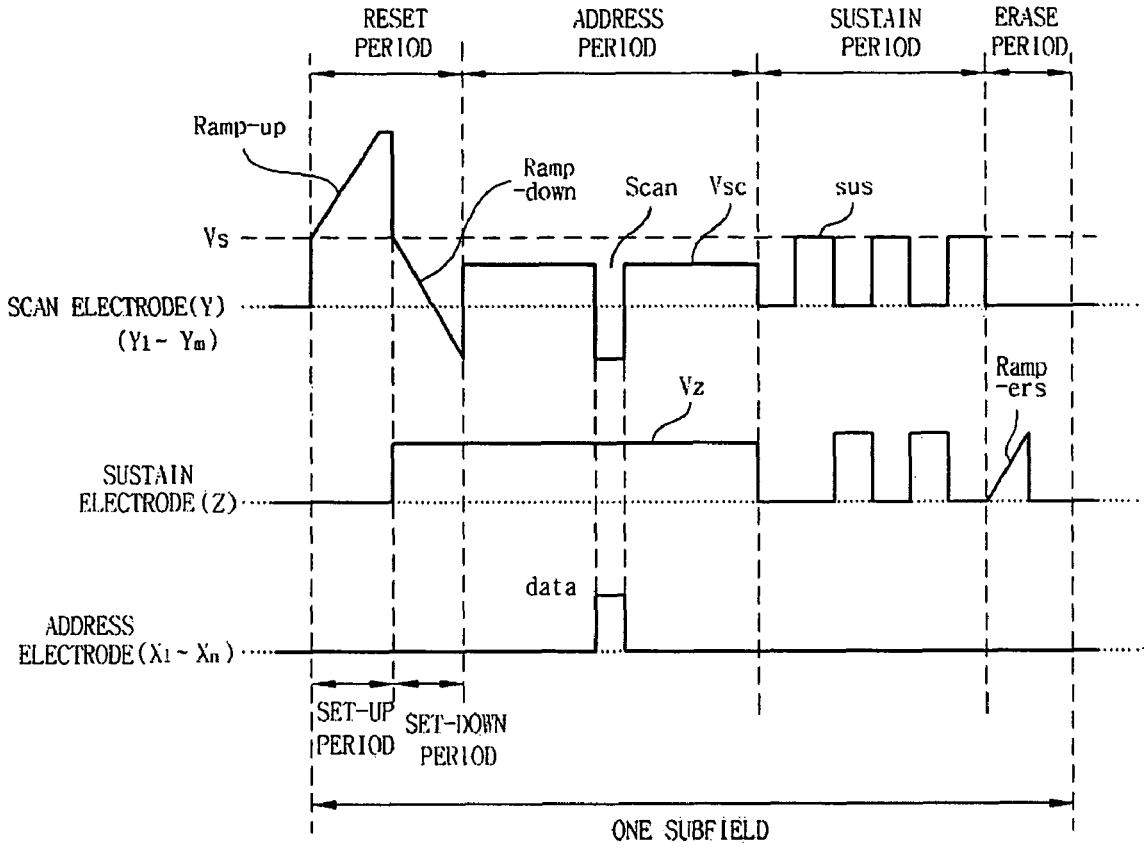
FIG. 3 illustrates driving waveforms according to an example arrangement.

FIG. 3 illustrates driving waveforms according to an example arrangement. Other arrangements are also possible. As showing in FIG. 3, a plasma display panel may be driven by being divided into a reset period for initializing all the cells, an address period for selecting cells to be discharged, a sustain period for sustaining discharge in the selected cells, and an erasing period for erasing wall charges in the discharged cells. The reset period may include a set-up period and a set-down period.

In the set-up period of the reset period, a ramp-up waveform may be simultaneously applied to all scan electrodes so that weak dark discharge occurs in all the scan electrodes due to the ramp-up wave. During the set-up period, positive wall charges are accumulated over the address electrodes and the sustain electrodes, and negative wall charges are accumulated over the scan electrodes.

After the ramp-up waveform is supplied, a ramp-down waveform is applied in the set-down period to the scan electrodes. The ramp-down waveform decreases from a positive voltage lower than a peak voltage of the ramp-up waveform to a predetermined voltage lower than a ground voltage. This may cause a weak erasing discharge in the cells, thereby sufficiently erasing the wall charges excessively generated over the scan electrodes. As a result, the wall charges may remain uniformly in the cells to cause the address discharge stably due to the set-down discharge.

In the address period, a scan reference waveform with a scan reference voltage Vsc may be applied to the scan electrodes, and a negative scan pulse (or signal or waveform) decreasing from the scan reference voltage Vsc of the scan reference waveform may be sequentially applied to the scan electrodes. Additionally, a positive data pulse (or signal or waveform) synchronized with the scan pulse may be simultaneously applied to the address electrodes. As the voltage difference between the scan pulse and the data pulse, and the voltage of the wall charges generated during the reset period are added, address discharge may be caused within the discharge cells to which the data pulse is applied. Wall charges remain within the cells selected due to the address discharge to a degree by which the discharge can be caused when a sustain voltage Vs is applied. The sustain electrode is supplied with a positive voltage Vz so that the sustain electrode does not cause a wrong discharge with the scan electrode by reducing the voltage difference with the scan electrode during the set-down period of the reset period and the address period.

In the sustain period, the scan electrodes and the sustain electrodes are alternately applied with a sustain pulse Sus (or sustain signal or sustain waveform). As the voltage of the wall charge within the cell and the sustain pulse are added in the cells selected due to the address discharge, the sustain discharge (i.e., the display discharge) is caused between the scan electrode and the sustain electrode whenever each sustain pulse is applied.

After the sustain discharge is completed, an erasing waveform with a small pulse width and a low voltage level is applied to the sustain electrode so that wall charges remaining within the cells constituting the whole picture are erased. The erasing waveform may be shown as Ramp-ers.

In the plasma display panel driven by such driving waveforms, a time point to apply a scan reference waveform to the scan electrodes in the address period may be identical for every scan electrodes, and the scan electrodes may be supplied with a waveform that is rapidly rising. One arrangement for applying time of scan reference waveform in the address period is shown in FIG. 4.

Figure 4:
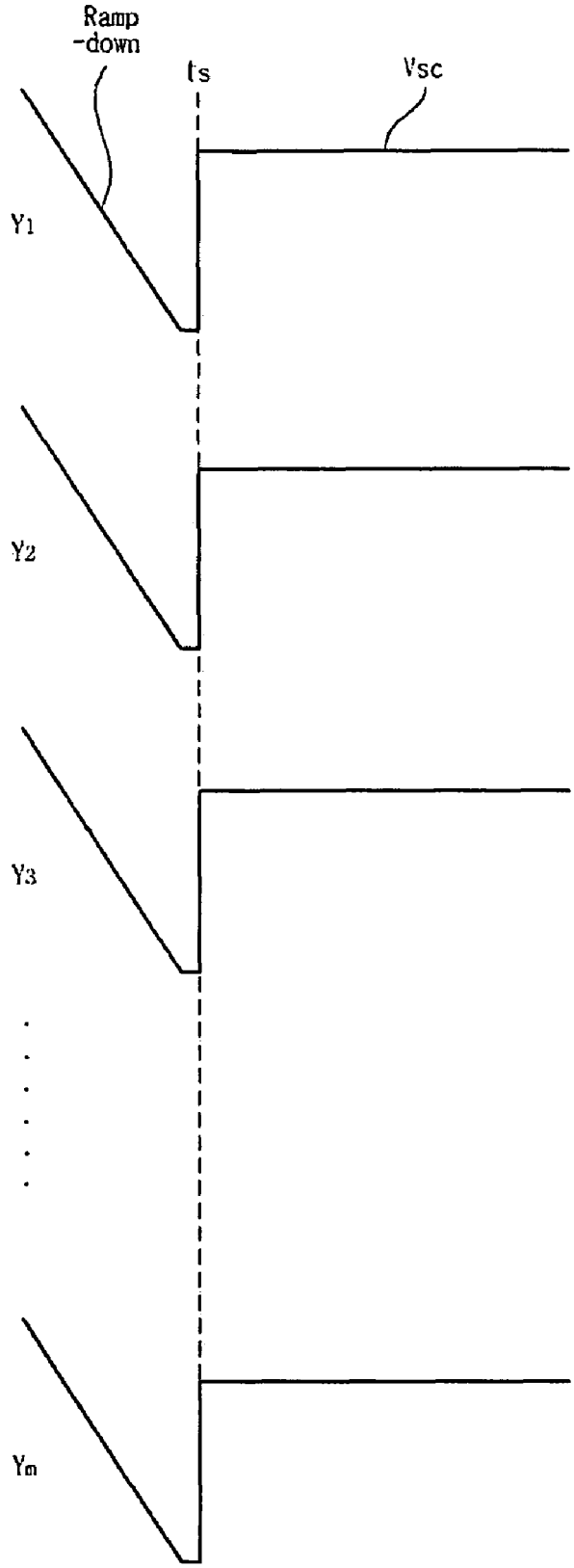
FIG. 4 illustrates waveforms to explain time points to apply a scan reference waveform in an address period according to an example arrangement.

FIG. 4 illustrates waveforms to explain time points to apply a scan reference waveform in an address period according to an example arrangement. More specifically, a scan reference waveform applied to the scan electrodes in an address period may be simultaneously applied to all the scan electrodes at a time "ts." When the scan reference waveform is applied to all the scan electrodes at the identical time point, noise may be generated in the scan reference waveform applied to the scan electrodes. An example of noise that is generated when the scan reference waveform is applied to the scan electrodes at the identical time point is shown in FIG. 5.

Figure 5:
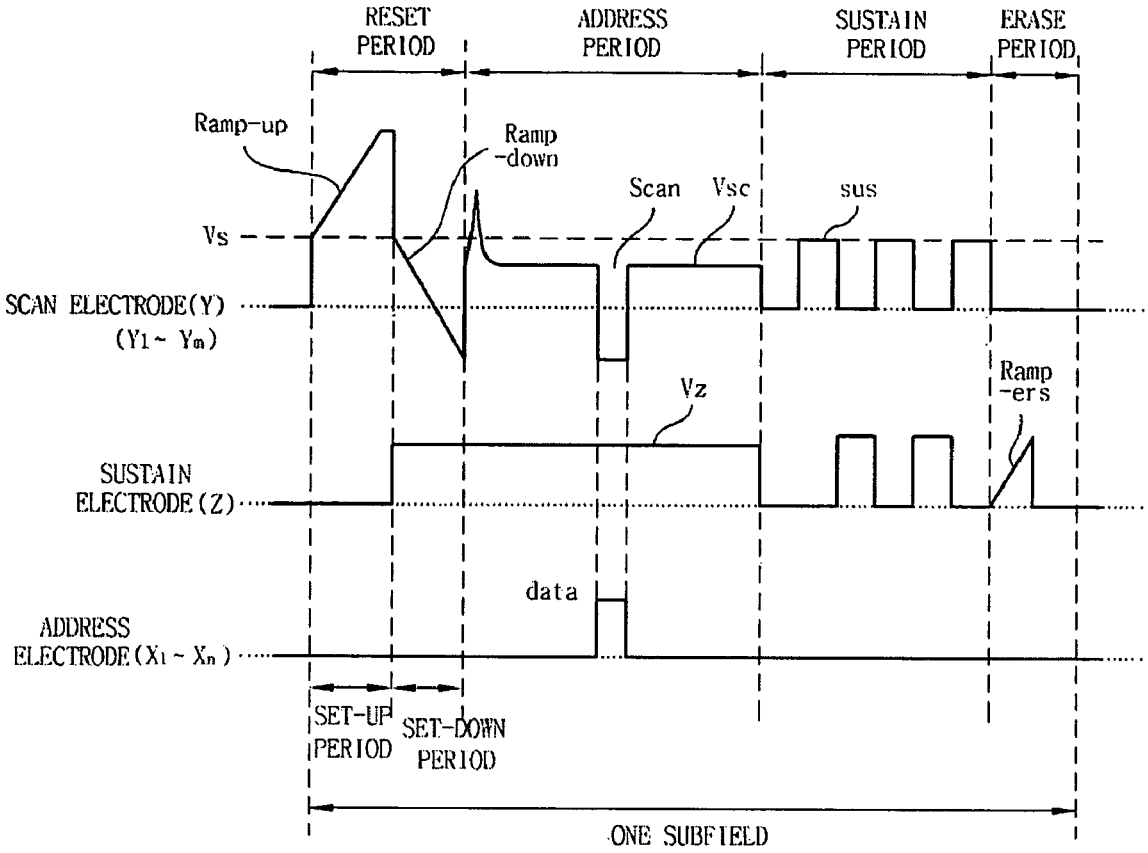
FIG. 5 illustrates a view for explaining generation of noise attributed to a identical time point when applying a scan reference waveform to the scan electrodes in an address period according to an example arrangement.

FIG. 5 illustrates a view for explaining generation of noise attributed to an identical time point when applying the scan reference waveform to the scan electrodes in an address period according to an example arrangement of driving a plasma display panel. As shown in FIG. 5, if a scan reference waveform is abruptly applied to scan electrodes at an identical time for all the scan electrodes in an address period, noise may occur in a driving waveform. Such noise may be generated due to coupling caused by capacitance in the panel, and a rising noise may be generated in the driving waveform applied to the scan electrodes at the time when a voltage of the scan reference waveform rapidly rises.

Accordingly, driving methods of a plasma display panel may have drawbacks that noise may occur in the scan reference waveform applied to the scan electrodes in case that the scan reference waveform is applied to the scan electrodes at an identical time point. Such noise may cause damage to a driving unit of a plasma display panel such as to a scan driver integrated circuit (IC) for applying a scan pulse to the scan electrodes.

First Embodiment

Figure 6:
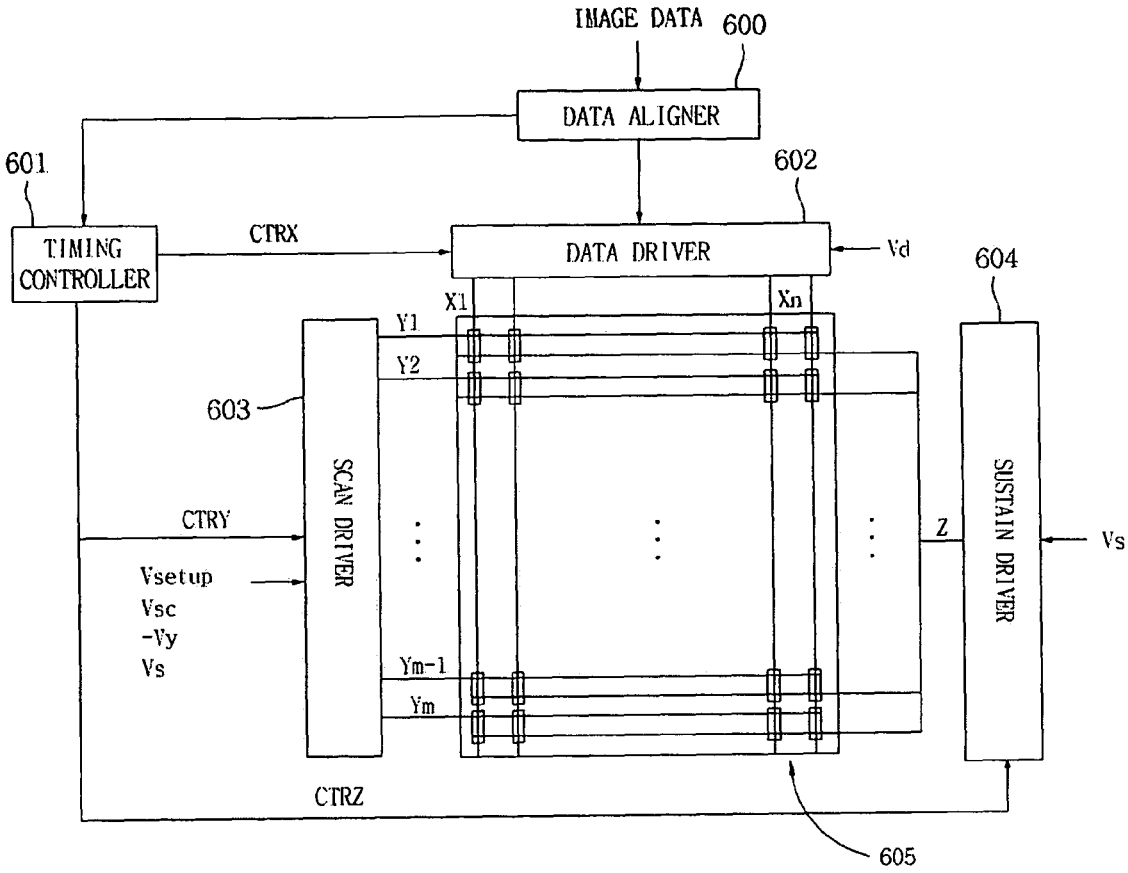
FIG. 6 is a block diagram of a plasma display apparatus according to a first embodiment of the present invention.

FIG. 6 is a block diagram of a plasma display apparatus according to an example embodiment of the present invention. Other embodiments and configurations are also within the scope of the present invention.

More specifically, FIG. 6 shows a plasma display apparatus that includes a data aligner 600, a timing controller 601, a data driver 602, a scan driver 603, a sustain driver 604 and a plasma display panel 605.

The plasma display panel 605 may include one or more scan electrodes, one or more sustain electrodes running in parallel with the scan electrodes, and one or more address electrodes extending to intersect the sustain electrodes and the scan electrodes.

The data aligner 600 may align incoming image data to be applied to the address electrodes $X_1$ to $X_n$. The data driver 602 may apply data pulses of the aligned image data to the address electrodes $X_1$ to $X_n$ of the plasma display panel 605.

The timing controller 601 may control timing of pulses (or signals or waveforms) of the scan driver 603 and the sustain driver 604.

The scan driver 603 may apply a scan reference waveform, a scan pulse and a sustain pulse to each of the scan electrodes $Y_1$ to $Y_m$. The scan pulse may also be referred to as a scan signal and/or a scan waveform. The sustain pulse may also be referred to as a sustain signal and/or a sustain waveform.

The sustain driver 604 may apply a sustain pulse (or sustain signal or sustain waveform) to each of the sustain electrodes Z. The plasma display panel 605 is driven by such a procedure.

The plasma display apparatus in accordance with the first embodiment of the present invention may control a ramp-up waveform applied to scan electrodes in an address period (i.e., controls a voltage of a scan reference waveform).

The timing controller 601 may control the scan driver 603, thereby controlling the ramp-up waveform applied to the scan electrode in the address period as described above (i.e., controlling the scan reference waveform). In a set-down period of a reset period, the scan driver 603 may sequentially apply a ramp-down waveform decreasing to a first voltage (i.e., a set-down pulse) to a plurality of scan electrodes and apply a ramp-up waveform increasing from the first voltage to a second voltage with a predetermined gradient to the scan electrodes. That is, the scan diver 603 may apply the scan reference waveform to the scan electrodes increasing from a lower end of the set-down pulse described above to a scan reference voltage Vsc with the predetermined gradient. The scan driver 603 may then apply a scan pulse decreasing from the scan reference voltage Vsc of the scan reference waveform.

A method of driving the plasma display apparatus by controlling the ramp-up waveform applied to the scan electrodes in the address period (i.e., controlling the scan reference waveform) will now be described with reference to FIGS. 7A to 7C.

Figure 7A:
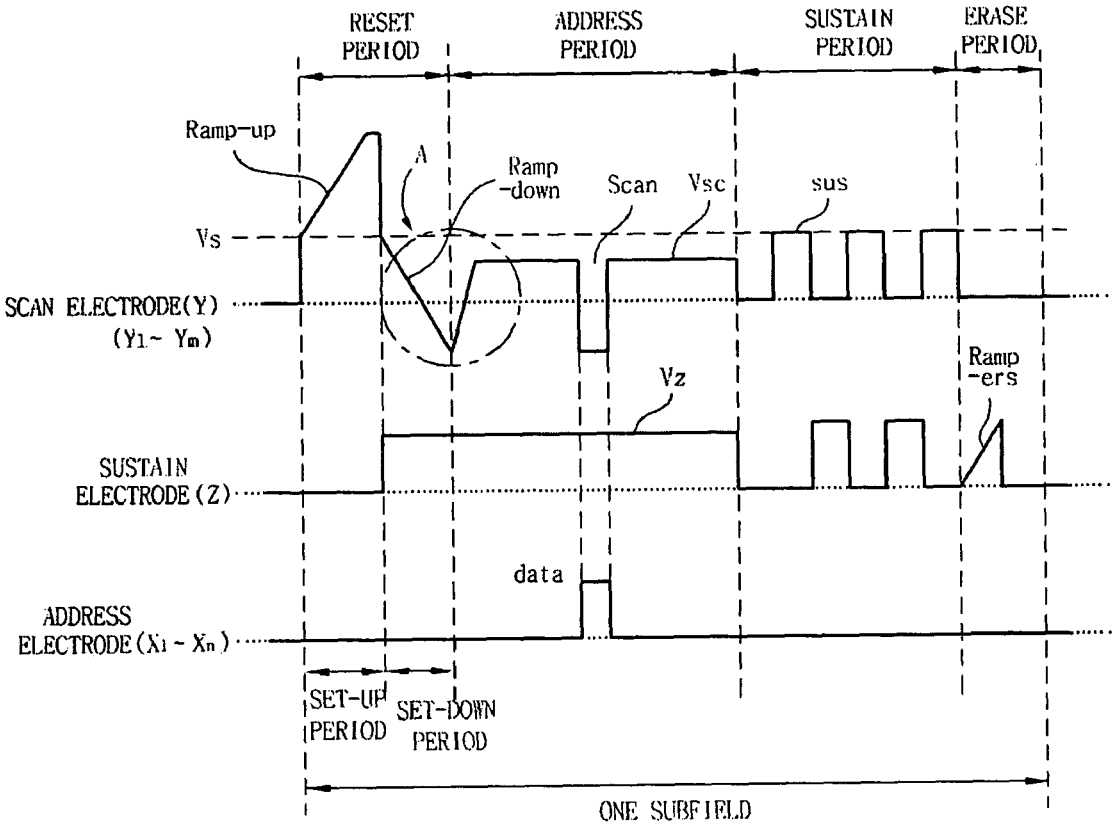
FIG. 7A to FIG. 7C are waveform views for explaining a driving method of a plasma display apparatus according to an example embodiment of the present invention.
Figure 7B:
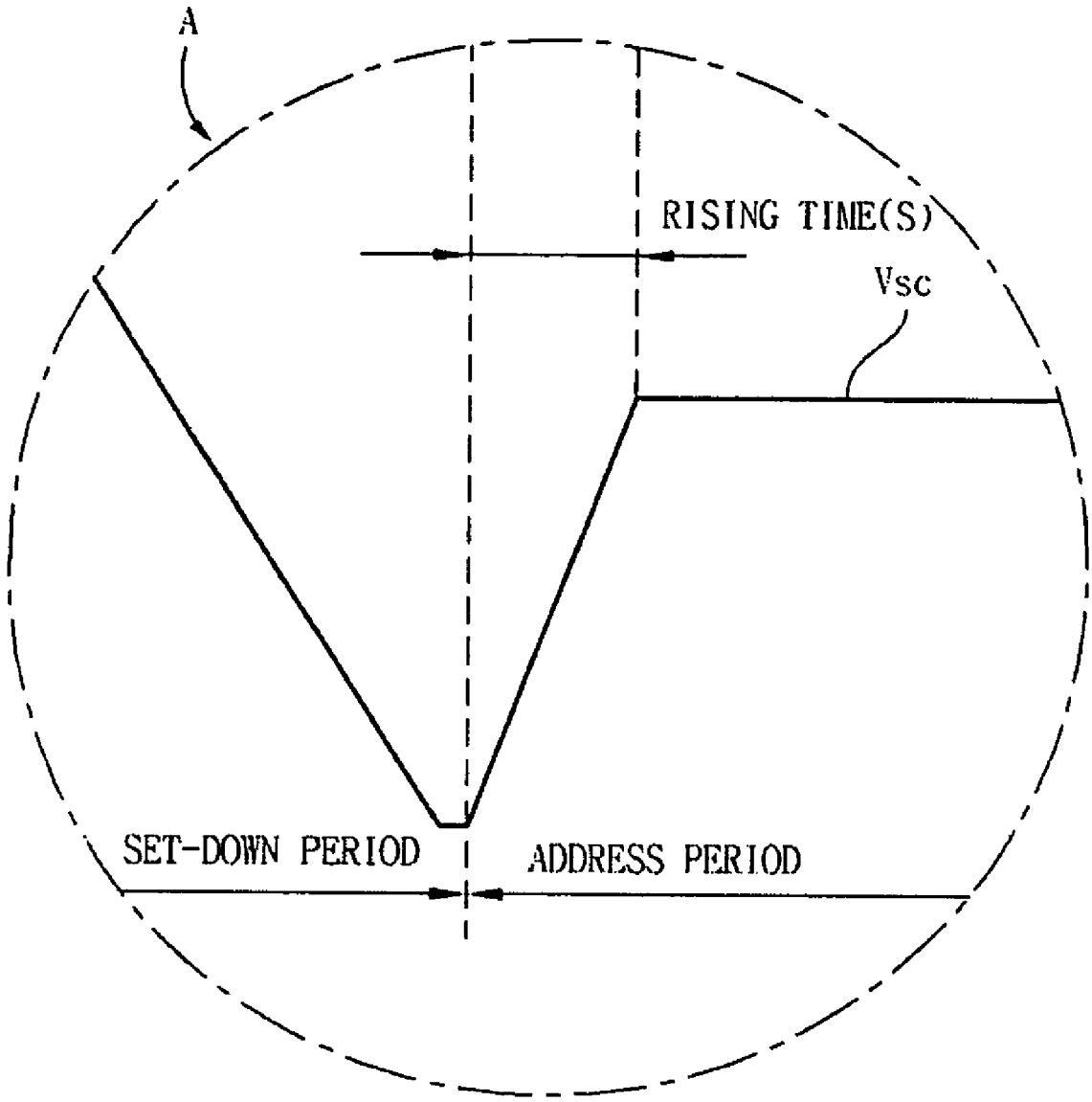
Figure 7C:
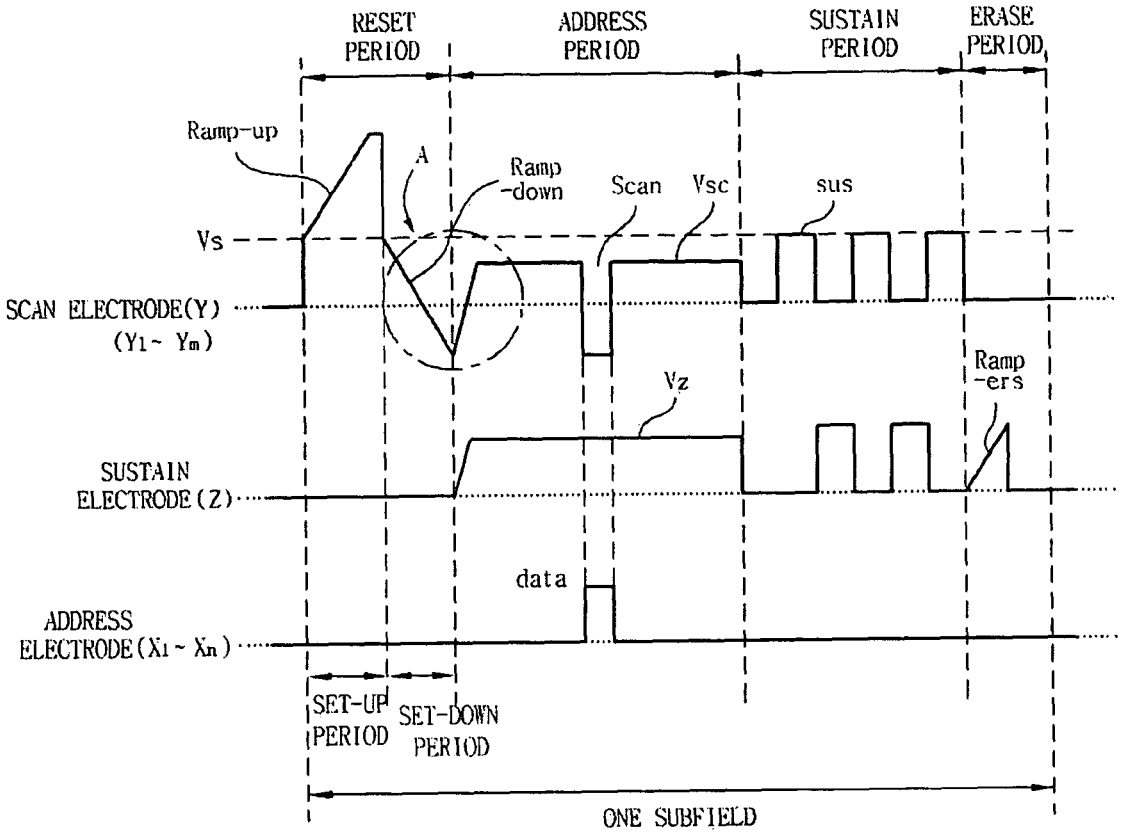

FIG. 7A and FIG. 7C are views for explaining a driving method of the plasma display apparatus shown in FIG. 6 in accordance with an example embodiment of the present invention. Other embodiments and waveforms are also within the scope of the present invention.

As shown in FIG. 7A and FIG. 7B, the driving method of the plasma display apparatus may display an image composed of a predetermined number of frames, each of which may be formed by the combination of one or more sub-fields in each of which an address electrode, a scan electrode and a sustain electrode are supplied with predetermined pulses (or signals or waveforms), respectively, in a reset period, an address period and a sustain period thereof, respectively. A ramp-up waveform (i.e., a scan reference waveform) may be applied to the scan electrode in the address period and be controlled to increase with a predetermined gradient.

Referring to FIG. 7A, in the set-down period of the reset period coming before the address period, a scan electrode may be applied with a ramp-down waveform decreasing to a first voltage −Vw. Then, in the address period, the scan electrode may be continuously applied with a ramp-up waveform that starts to increase from the first voltage and that increases to a second voltage (i.e., a scan reference voltage Vsc). Then, a scan pulse (or signal or waveform) decreasing from the second voltage to a third voltage −Vy may be applied to the scan electrodes.

The first voltage applied to the scan electrodes during the set-down period and the third voltage −Vy, which is a voltage of the scan pulse, may be identical or substantially identical.

When the scan pulse with the third voltage is applied to the scan electrode, a data pulse (or signal or waveform) may be applied to one of the address electrodes by being synchronized with the scan pulse so that an address discharge may occur.

Next, as the sustain pulse is supplied to the scan electrode and the sustain electrode in the sustain period, radiation caused due to the address discharge by the data pulse and the scan pulse in the address period may be maintained.

FIG. 7B is a view for further showing part A from FIG. 7A. In FIG. 7B, the ramp-up waveform is applied to the scan electrodes until a first scan pulse among a plurality of scan pulses is applied to one of the scan electrodes. In other words, the voltage of the scan reference waveform continuously increases during a period between a time point when the set-down pulse of the ramp-down waveform reaches a lower bottom level in the set-down period of the reset period and a time point when the first scan pulse begins to be supplied to one of the scan electrodes.

Such an applying time of the ramp-up waveform may range from 0 to 20 microseconds, for example. That is, the ramp-up waveform may be applied during a time period greater than 0 microseconds and not beyond 20 microseconds. Additionally, the applying time of the ramp-up waveform may range from 6 to 10 microseconds. That is, the ramp-up waveform may be applied during a time period greater than 6 microseconds and not beyond 20 microseconds. Further, as described above, a gradient $\alpha$ of the ramp-up waveform may be more gentle than a gradient $\beta$ of the sustain pulse supplied in the sustain period.

A driving method of the plasma display apparatus according to the present invention shown in FIG. 7C is almost the same as the driving method shown in FIG. 7A. Only, a bias waveform different from the bias waveform applied to the sustain electrode during the set-down period and the address period in FIG. 7A is applied to the sustain electrode during the address period.

At this time, the voltage Vz of the bias waveform may be identical to the voltage Vs of the sustain pulse. Further, the bias waveform is controlled to increase with a predetermined gradient.

In accordance with the method described above, a magnitude of noise generated due to the scan reference waveform applied to the scan electrodes in the address period may become smaller. Such noise reduction may be seen in FIG. 8.

Figure 8:
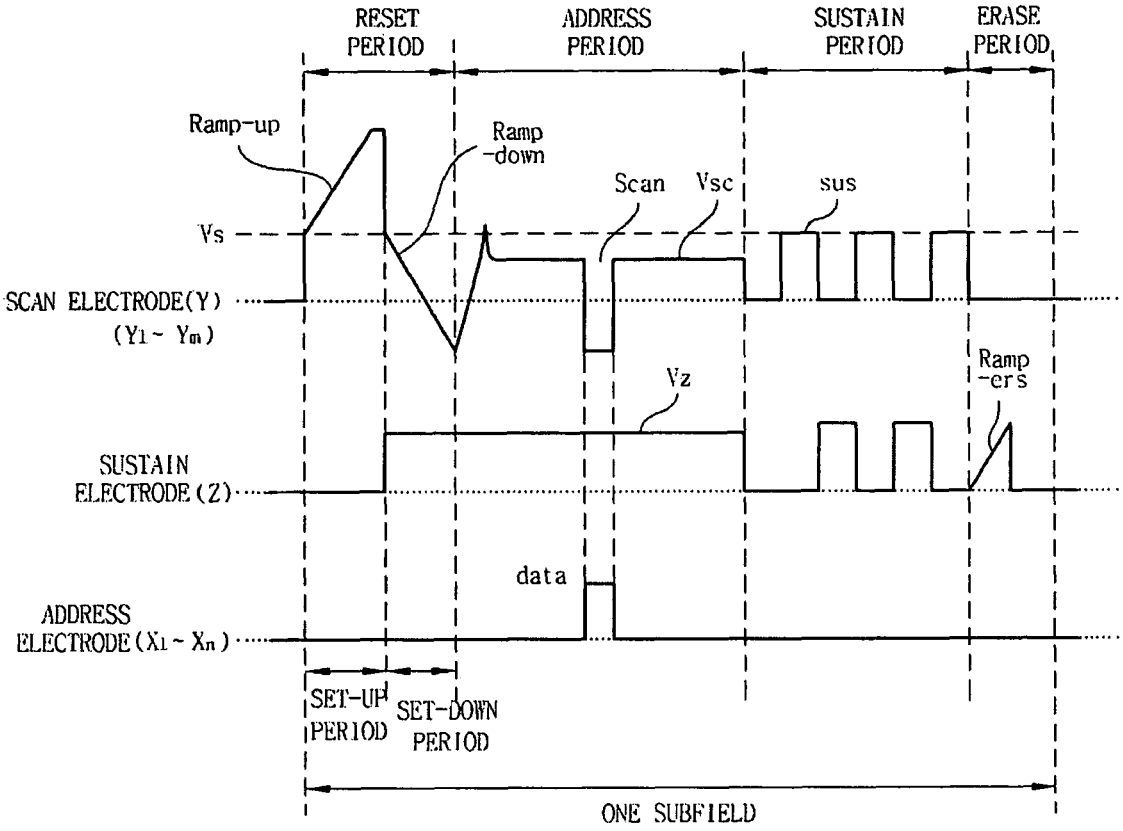
FIG. 8 is a view for explaining noise reduction achieved by a driving method of a plasma display apparatus according to an example embodiment of the present invention.

FIG. 8 is a view for explaining noise reduction achieved by a driving method of the plasma display apparatus according to an example embodiment of the present invention. More specifically, FIG. 8 shows that a magnitude of the noise in the waveform applied to the scan electrode in the address period may be smaller than the magnitude of noise in FIG. 5. The reason for the noise reduction is that the ramp-up waveform applied to the scan electrodes Y1 to Ym is controlled. That is, a rising time of a voltage of the scan reference waveform that gradually rises may be controlled to be in a range from 0 to 20 microseconds, and more specifically in a range from 6 to 10 microseconds, for example. Coupling caused due to capacitance of the panel when the scan reference waveform is applied may be reduced by the control of the voltage rising time, whereby rising noise generated due to the waveform applied to the scan electrodes when the scan reference waveform rapidly rises may be reduced. As a result, damage to a plasma display panel driving element (i.e., a scan driver IC of a scan driver) may be prevented.

In the driving method according to the first embodiment of the present invention, a voltage rising time of the scan reference waveform applied to all the scan electrodes Y1 to Ym may be controlled to be in a range from 0 to 20 microseconds, and/or from 6 to 10 microseconds, for example. Other methods, values and rising times are also within the scope of the present invention. As one example, the scan electrodes Y1 to Ym may be divided into a plurality of scan electrode groups, and voltage rising times of scan reference waveforms applied to the scan electrode groups in the address period may be different. That is, voltage rising times of scan reference waveforms applied to the divided scan electrode groups, respectively, may be different in the address period. Additionally, applying times of ramp-up waveforms may be controlled to be different.

Second Embodiment

Figure 9:
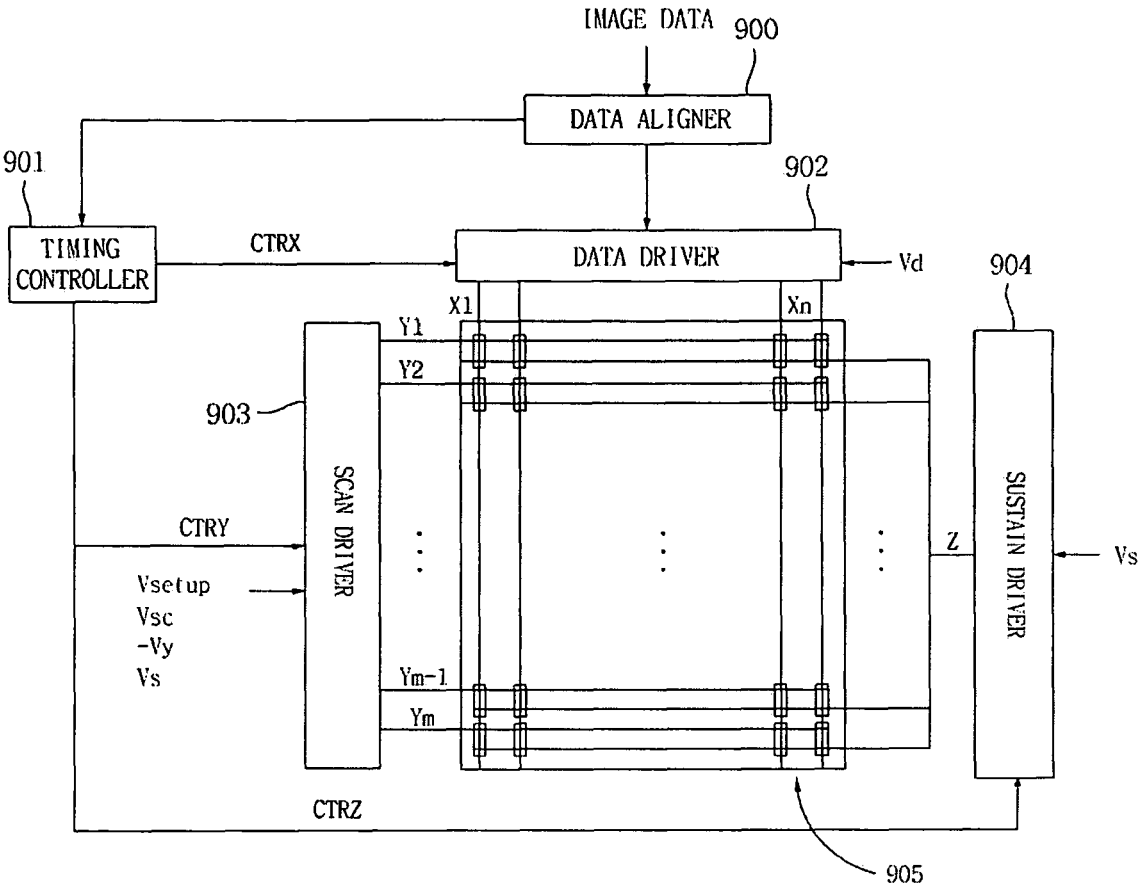
FIG. 9 is a block diagram of a plasma display apparatus according to a second embodiment of the present invention.

FIG. 9 is a block diagram of a plasma display apparatus in accordance with a second embodiment of the present invention. Other embodiments and configurations are also within the scope of the present invention.

More specifically, FIG. 9 shows a plasma display apparatus that includes a data aligner 900, a timing controller 901, a data driver 902, a scan driver 903, a sustain driver 904 and a plasma display panel 905.

The plasma display panel 905 includes one or more scan electrodes, one or more sustain electrodes arranged in parallel with the scan electrodes and one or more address electrodes arranged to intersect the scan electrodes and the sustain electrodes.

The data aligner 900 may align incoming image data input from outside to be applied to the address electrodes X1 to Xn.

The data driver 902 may apply the aligned data pulses to the address electrodes X1 to Xn of the plasma display panel 905.

The timing controller 901 may control timing of pulses of the scan driver 903 and the sustain driver 904.

The scan driver 903 may apply a scan pulse and a sustain pulse to the scan electrodes Y1 to Ym.

The sustain driver 904 may apply the sustain pulse to the sustain electrodes Z. The plasma display apparatus may be driven by such a procedure.

In accordance with the second embodiment of the present invention, the scan electrodes Y1 to Ym (m is a positive integer) may be divided into a plurality of scan electrode groups, and one or more scan electrode group may be applied with a scan reference waveform having a different rising time of a ramp-up waveform from others applied to the other scan electrode groups in an address period. That is, a rising time of the scan reference waveform applied to one scan electrode group may be different from the rising time of the scan reference waveform applied to the other scan electrode groups. The rising time is the period of time for a scan reference waveform to rise gradually to a scan reference voltage.

Before describing the operation of the plasma display apparatus in accordance with the second embodiment of the present invention, the concept of the scan electrode groups will be briefly described with reference to FIG. 10.

Figure 10:
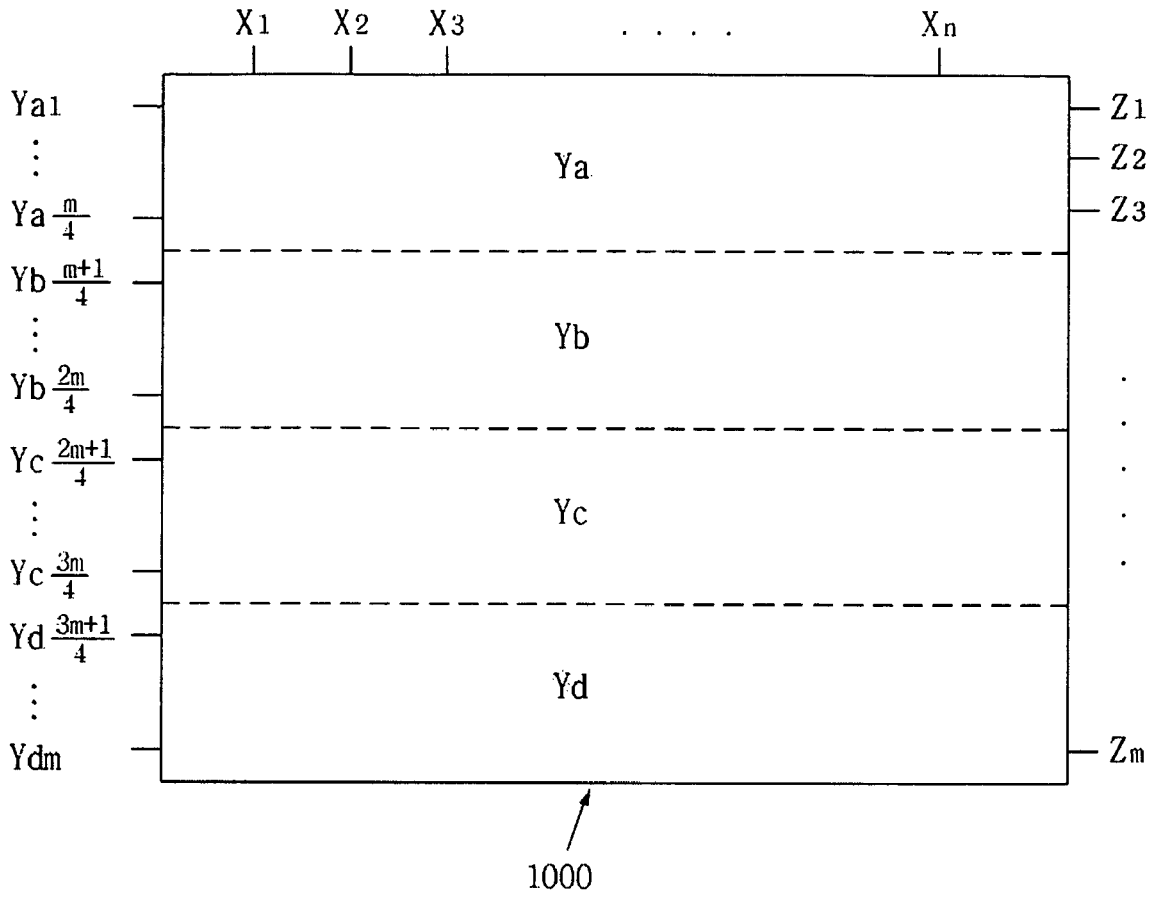
FIG. 10 is a view for explaining scan electrode groups.

FIG. 10 illustrates a view for explaining scan electrode groups. FIG. 10 shows that scan electrodes Y1 to Ym of a plasma display panel 1000 may be divided into an Ya electrode group Ya1 to Ya(m)/4, an Yb electrode group Yb(m+1)/4 to Yb(2m)/4, an Yc electrode group Yc(2m+1)/4 to Yc(3m)/4 and an Yd electrode group Yd(3m+1)/4 to Yd(m).

In FIG. 10, the number of scan electrodes belonging each of the Ya, Yb, Yc and Yd scan electrode groups are identical. However, the number of scan electrodes belonging to each of the scan electrode groups may be different. For instance, the Ya electrode group may include 100 scan electrodes and the Yb electrode group may include 200 scan electrodes.

Further, the number of scan electrode groups can be controlled. The number of the scan electrode groups may range from 2 to a number less than a total number of scan electrodes. That is, the number of the scan electrode groups may be in the range of $2 \leqq M \leqq (m-1)$, where M is the number of the scan electrode groups and m is the number of the scan electrodes.

Based on the above description of scan electrode groups with reference to FIG. 10, the plasma display apparatus shown in FIG. 9 in accordance with the second embodiment of the present invention will now be described in more detail.

In the plasma display apparatus, the scan electrodes Y1 to Ym (m is a positive integer) may be divided into a plurality of electrode groups. The timing controller 901 may control the scan driver 903 for an applying time of a ramp-up waveform applied to one or more scan electrode groups during an address period such that a rising time of a voltage of a scan reference waveform is different from a rising time of a voltage applied to the other scan electrode groups. That is, the scan driver 903 may control an applying time of a ramp-up waveform applied to one or more scan electrode groups in the address period. The scan driver 903 controls a rising time of a voltage of the scan reference waveform that is gradually rising and applied to the one or more scan electrode groups in the address period such that the rising time is different than the rising time of the scan reference waveform applied to the other scan electrode groups.

The applying time of the ramp-up waveform may be controlled to be within a range corresponding to a period between a time point that the set-down pulse of the ramp-down is decreased to a lower bottom level in the set-down period of the reset period and a time point that a first scan pulse is applied to the scan electrodes. The applying time of the ramp-up waveform may be considered the rising time of a voltage of the scan reference waveform that rises gradually.

Such an applying time of a ramp-up waveform (i.e., a gradual rising time of a voltage of a scan reference waveform) may be controlled to be longer than 0 microseconds and shorter than 20 microseconds, for example. Additionally, the applying time may be controlled to be in the range from 6 to 10 microseconds.

Further, when the scan electrodes Y1 to Ym are divided into a plurality of scan electrode groups in the plasma display apparatus in accordance with the second embodiment of the present invention, the number of scan electrodes belonging to one scan electrode group may be 2 or more and/or less than a total number of scan electrodes. For example, the number of scan electrode groups can be 4, 6, or 10, and the applying times of the ramp-up waveform applied to the scan electrode groups in an address period may be set up to be different for each scan electrode group. Each of the scan electrode groups may include one or more scan electrodes, and all the scan electrode groups can include an identical number of scan electrodes or alternately include a different number of scan electrodes.

As described above, all the scan electrodes belonging to a same scan electrode group may be applied with a ramp-up waveforms having an identical applying time. For example, all the scan electrodes Ya1 to Ya(m)/4 belonging to the Ya electrode group may be applied with scan reference waveforms, respectively, having the identical rising time. That is, the applying time of the scan reference waveforms applied to scan electrodes Ya1 to Ya(m)/4 of the Ya electrode group may be 5 microseconds, and the applying time of the scan reference waveforms applied to the scan electrodes Yb1 to Yb(m)/4 of the Yb electrode group may be 10 microseconds. In such a way, the applying time of ramp-up waveforms applied to the scan electrodes in one scan electrode group may be identical and/or substantially identical.

Further, a time difference between two ramp-up waveforms with different applying times can be set up to be identical. For example, the applying times of ramp-up waveforms applied to all the scan electrodes Ya1 to Ya(m)/4 belonging to the Ya electrode group as shown in FIG. 10 may be 5 microseconds, the applying times of ramp-up waveforms applied to all the scan electrodes Yb1 to Yb(m)/4 belonging to the Yb electrode group may be 10 microseconds, the applying times of ramp-up waveforms applied to all the scan electrodes Yc1 to Yc(m)/4 belonging to the Yc electrode group as shown in FIG. 10 may be 15 microseconds, and the applying times of ramp-up waveforms applied to all the scan electrodes Yd1 to Yd(m)/4 belonging to the Yd electrode group as shown in FIG. 10 may be 20 microseconds. That is, a time difference between the applying time of the waveforms applied to the Ya scan electrode group and the applying time of the waveforms applied to the Yb scan electrode group is 5 microseconds, a time difference between the applying time of the waveforms applied to the Yb scan electrode group and the applying time of the waveforms applied to the Yc scan electrode group is 5 microseconds, and a time difference between the applying times of the waveforms applied to the Yc scan electrode group and the applying times of the waveforms applied to the Yd scan electrode group is 5 microseconds.

Alternatively, the time differences between the different applying times may be different. That is, the applying time of the ramp-up waveforms applied to all the scan electrodes Ya1 to Ya(m)/4 belonging to the Ya electrode group as shown in FIG. 10 may be 5 microseconds, the applying time of the ramp-up waveforms applied to all the scan electrodes Yb1 to Yb(m)/4 belonging to the Yb electrode group may be 7 microseconds, the applying time of ramp-up waveforms applied to all the scan electrodes Yc1 to Yc(m)/4 belonging to the Yc electrode group as shown in FIG. 10 may be 15 microseconds, and the applying time of the ramp-up waveforms applied to all the scan electrodes Yd1 to Yd(m)/4 belonging to the Yd electrode group as shown in FIG. 10 may be 20 microseconds. That is, a time difference between the applying time of the waveforms applied to the Ya scan electrode group and the applying times of the waveforms applied to the Yb scan electrode group may be 2 microseconds, a time difference between the applying times of the waveforms applied to the Yb scan electrode group and the applying times of the waveforms applied to the Yc scan electrode group may be 8 microseconds, and a time difference between the applying times of the waveforms applied to the Yc scan electrode group and the applying times of the waveforms applied to the Yd scan electrode group may be 5 microseconds.

A method of driving a plasma display panel by controlling the applying times of ramp-up waveforms applied to the scan electrodes in an address period will now be described with reference to FIG. 11A to FIG. 11B.

Figure 11A:
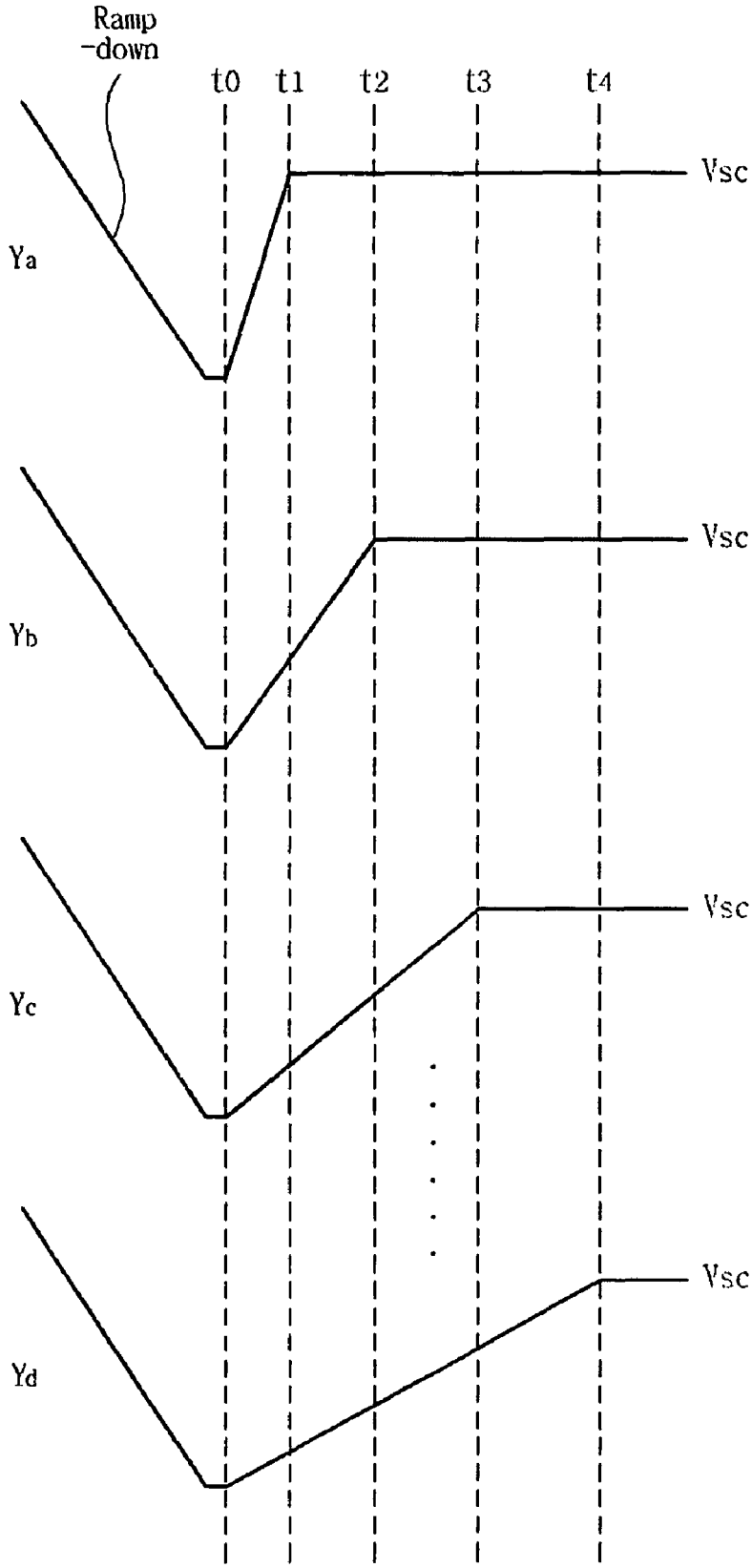
FIGS. 11A and 11B are views for explaining a driving method of a plasma display apparatus according to an example embodiment of the present invention.
Figure 11B:
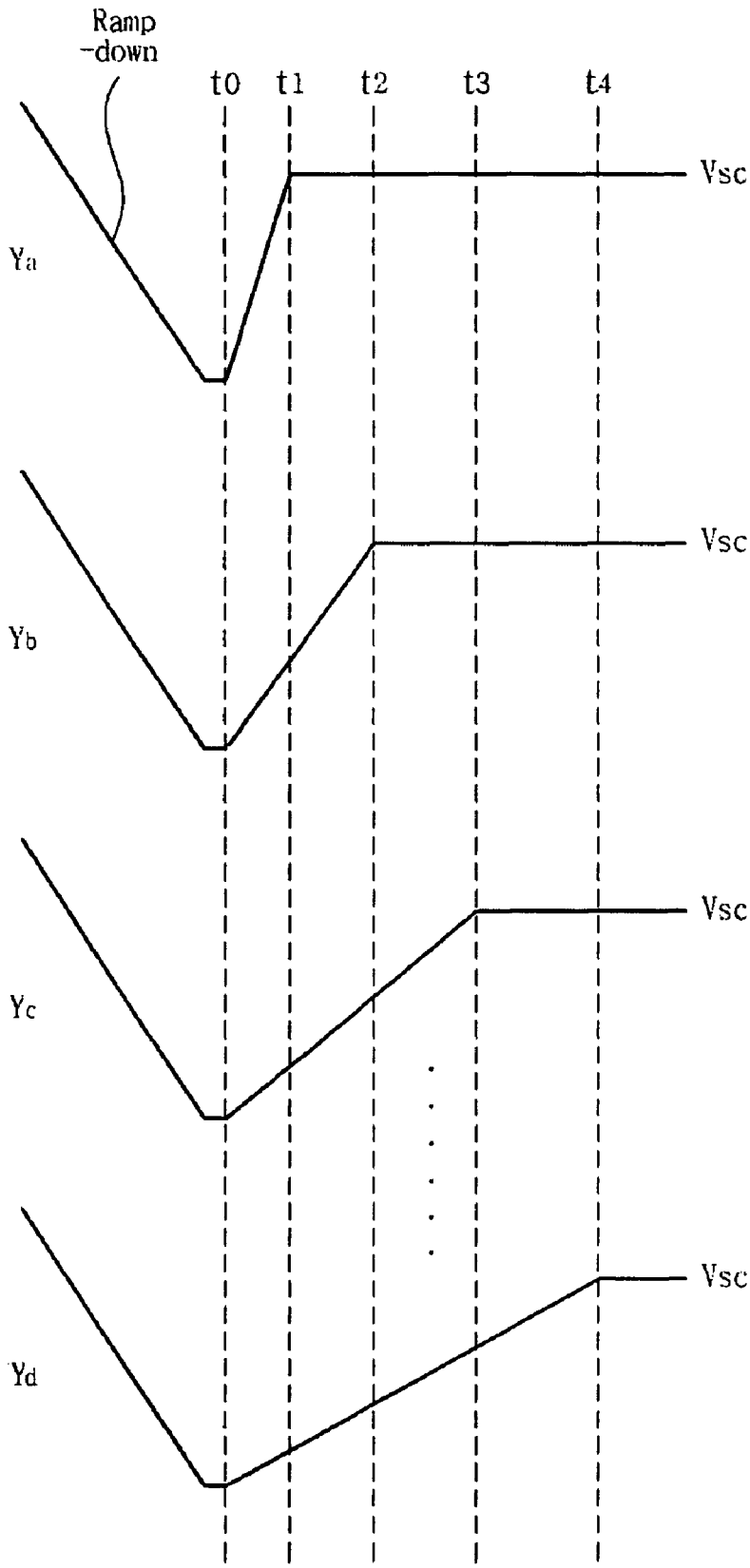

FIG. 11 and FIG. 11B are views for explaining a method of driving a plasma display apparatus such as shown in FIG. 9 in accordance with the present invention.

Referring to FIG. 11A and FIG. 11B, a method of driving a plasma display apparatus in accordance with the present invention may display an image composed of a predetermined number of frames by combining one or more subfields, in each of which an address electrode, scan electrodes Y1 to Ym (m is a positive integer) and a sustain electrode are supplied with predetermined pulses in a reset period, an address period and a sustain period. The scan electrodes may be divided into at least two scan electrode groups. An applying time of a ramp-up wave applied to one or more scan electrode group may be controlled so as to be different from an applying time of a ramp-up wave applied to the other scan electrode groups.

For example, as shown in FIG. 11A, all the scan electrodes belonging to the Ya scan electrode group shown in FIG. 10 may be supplied with a scan reference waveform that begins to increase at t0 and reaches a scan reference voltage Vsc at t1 (i.e., a ramp-up waveform with an applying time of t1−t0). All the scan electrodes belonging to the Yb scan electrode group shown in FIG. 10 may be supplied with a scan reference waveform that begins to rise at t0 and reaches a scan reference voltage Vsc at t2 (i.e., a ramp-up waveform with an applying time of t2−t0). All the scan electrodes belonging to the Yc scan electrode group shown in FIG. 10 are supplied with a scan reference waveform that begins to rise at to and reaches a scan reference voltage Vsc at t3 (i.e., a ramp-up waveform with an applying time of t3−t0). All the scan electrodes belonging to the Yd scan electrode group shown in FIG. 10 are supplied with a scan reference waveform that begins to increase at t0 and reaches a scan reference voltage Vsc at t4 (i.e., a ramp-up waveform with an applying time of t4−t0). That is, the applying times (or time durations) of the ramp-up waveforms applied to the scan electrode group may be different for each scan electrode group.

In FIG. 11A, all the scan electrode groups are supplied with scan reference waveforms with different voltage applying times, respectively. Alternatively, only selected scan electrode groups can be supplied with the scan reference waveforms with different voltage applying times, respectively. For example, all the scan electrodes belonging to the Ya scan electrode group are supplied with a scan reference waveform that begins to increase at to and reaches a scan reference voltage Vsc at t1 (i.e., a ramp-up waveform with an applying time of t1−t0), and all the scan electrodes belonging to the Yb scan electrode group, the Yc scan electrode group and the Yd scan electrode group can be supplied with a scan reference waveform that begins to increased at t0 and reaches a scan reference voltage Vsc at t2 (i.e., a ramp-up waveform with an applying time of t2−t0).

In case that the scan electrodes are divided into a plurality of scan electrode groups, and the ramp-up waveforms (i.e., the scan reference waveforms) are for the scan electrode groups, respectively, the number of scan electrode groups is preferably set up to be two (2) or more but less than a total number of the scan electrodes.

Here, each scan electrode group may include one or more scan electrodes, and all the scan electrode groups may include an identical number of scan electrode groups or include a different number of scan electrode groups.

For example, the Ya scan electrode group may include 100 scan electrodes and the Yb scan electrode group may include 200 scan electrodes.

Further, the scan electrodes belonging to the identical scan electrode group may be applied with identical ramp-up waves with identical applying time (i.e., the identical voltage rising time). That is, the voltage rising time of the scan reference waveforms, the rising time of ramp-up waveforms, applied to all the scan electrode groups Ya1 to Ya(m)/4 belonging to the Ya scan electrode group can be set up to be identical such as 10 microseconds, for example.

In FIG. 11, time differences every between the different applying times of the two ramp-up waveforms are identical. That is, if the time difference between the applying time of the ramp-up waveform applied to the Ya scan electrode group and the applying time of the ramp-up waveform applied to the Yb scan electrode group is 5 microseconds, the time difference between the applying times of the ramp-up waveforms applied to the Yb scan electrode group and the Yc scan electrode group, respectively, is 5 microseconds. Further, the time difference between the applying times of the ramp-up waveforms applied to the Yc scan electrode group and the Yd scan electrode group, respectively, is 5 microseconds.

Alternatively, differences can be set up to be different from each other as shown in FIG. 11B. More specifically, FIG. 11B shows the time differences are different from each other. For example, if the time difference (t2−t1) between the applying time of the ramp-up waveform applied to the Ya scan electrode group and the applying time of the ramp-up waveform applied to the Yb scan electrode group is 5 microseconds, the time difference (t3−t2) between the applying time of the ramp-up waveform applied to the Yb scan electrode group and the applying time of the ramp-up waveform applied to the Yc scan electrode group can be set up to be 7 microseconds. Additionally, the time difference (t4−t3) between the applying time of the ramp-up waveform applied to the Yc scan electrode group and the applying time of the ramp-up waveform applied to the Yd scan electrode group can be 10 microseconds.

Such a method may reduce the magnitude of noise caused by the ramp-up waveform applied to the scan electrode in an address period.

One reason for the noise reduction is that the applying times of the ramp-up waveforms applied to all the scan electrodes Y1 to Ym are not identical, the scan electrode are divided into a plurality of scan electrode groups, and an applying time of the ramp-up waves applied to one or more scan electrode groups is controlled to be different from an applying time of the ramp-up waves applied to the other scan electrode groups so that coupling that is caused due to capacitance of the panel when the scan reference waveform is applied is reduced, whereby rising noise generated to the waveform applied to the scan electrodes when the scan reference waveform rapidly rises is reduced. As a result, damage to a plasma display panel driving element (i.e. a scan driver IC of a scan driver) may be prevented.

In the driving method according to the second embodiment of the present invention, all scan electrodes Y1 to Ym may be divided into a plurality of scan electrode groups, and the applying times of the scan reference waveforms applied to the scan electrode groups are controlled to be different. However, the applying times may be different for each ramp-up waveform to be applied to each scan electrode. Such method will be described in more detail with reference to a third embodiment of the present invention.

Third Embodiment

Figure 12:
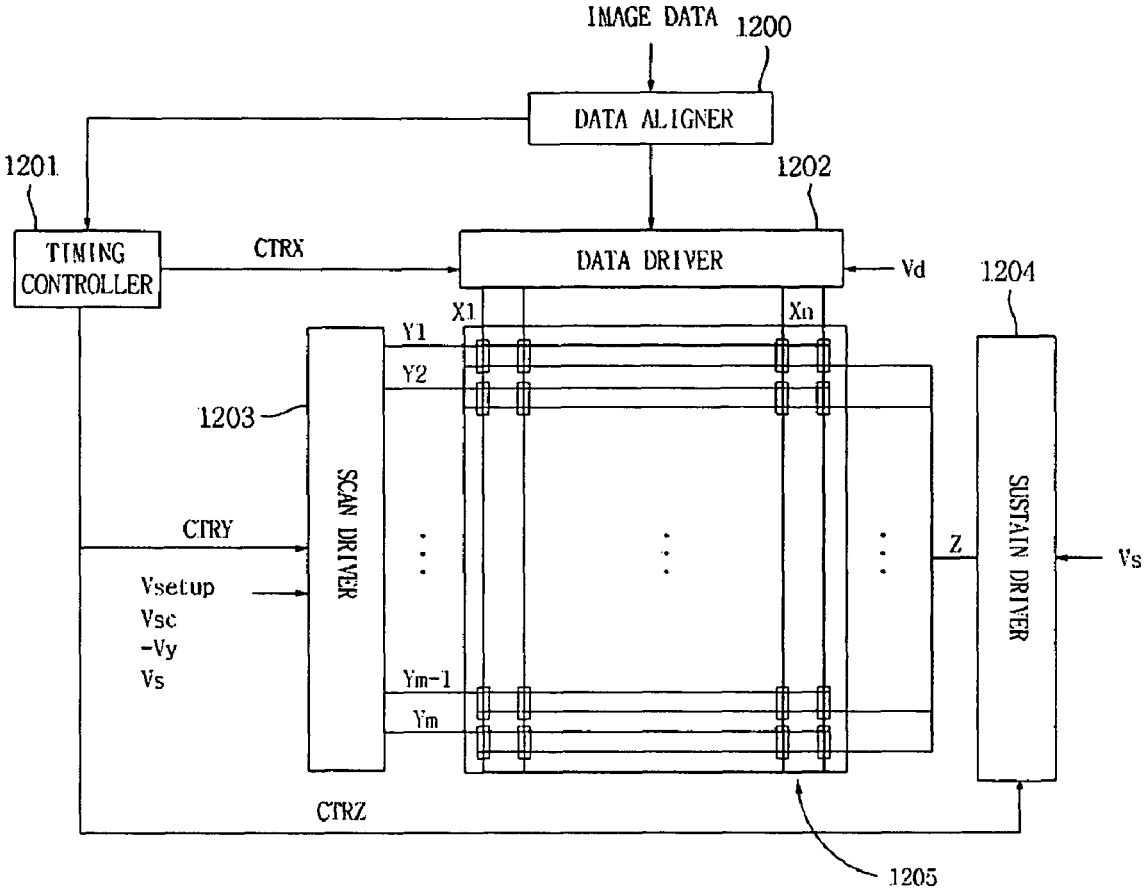
FIG. 12 is a block diagram of a plasma display apparatus according to a third embodiment of the present invention.

FIG. 12 is a block diagram of a plasma display apparatus in accordance with a third embodiment of the present invention. Other embodiments and configurations are also within the scope of the present invention.

More specifically, FIG. 12 shows a plasma display apparatus that includes a data aligner 1200, a timing controller 1201, a data driver 1202, a scan driver 1203, a sustain driver 1204 and a plasma display panel 1205.

The plasma display panel 1205 may include one or more scan electrodes, one or more sustain electrodes and one or more address electrodes arranged to intersect the sustain electrodes and the scan electrodes.

The data aligner 1200 may align incoming image data to be supplied to the address electrodes X1 to Xn.

The data driver 1202 may apply data pulses of the aligned image data to the address electrodes X1 to Xn.

The timing controller 1201 may control the timing of pulses of the scan driver 1203 and the sustain driver 1204.

The scan driver 1203 may apply scan pulses and sustain pulses to scan electrodes Y1 to Yn.

The sustain driver 1204 may apply sustain pulses to the corresponding sustain electrodes Z. The plasma display panel 1205 may be driven by such a procedure.

In accordance with the third embodiment of the present invention, applying times of ramp-up waveforms applied to the scan electrodes Y1 to Ym may be controlled to be different from each other.

As described above, in accordance with the third embodiment of the present invention, the timing controller 1201 may control the scan driver 1203 so that the applying times of ramp-up waveforms applied to the scan electrodes Y1 to Ym, respectively, in an address period are different from each other. That is, the scan driver 1203 may control the applying times of ramp-up waveforms applied to the scan electrodes Y1 to Ym in an address period to be different from each other under the control of the timer controller 1201.

A time differences between two different applying times can be set up to be identical. For example, it is possible that the applying time of the ramp-up waveform applied to the scan electrode Y1 is set up to be 5 microseconds, the applying time of the ramp-up waveform applied to the scan electrode Y2 is set up to be 10 microseconds, the applying time of the ramp-up waveform applied to the scan electrode Y3 is set up to be 15 microseconds, and the applying time of the ramp-up waveform applied to the scan electrode Y4 is set up to be 20 microseconds. That is, the time difference between the ramp-up waveforms applied to the scan electrode Y1 and the scan electrode Y2 is 5 microseconds, the time difference between the ramp-up waveforms applied to the scan electrode Y2 and the scan electrode Y3 is 5 microseconds, and the time difference between the ramp-up waveforms applied to the scan electrode Y3 and the scan electrode Y4 is also 5 microseconds.

Alternatively, the time differences between two different applying times can be set up to be different from each other. For example, the applying time of the ramp-up waveform applied to the scan electrode Y1 is set up to be 5 microseconds, the applying time of the ramp-up waveform applied to the scan electrode Y2 is set up to be 7 microseconds, the applying time of the ramp-up waveform applied to the scan electrode Y3 is set up to be 15 microseconds, and the applying time of the ramp-up waveform applied to the scan electrode Y4 is set up to be 20 microseconds. That is, the time difference between the ramp-up waveforms applied to the scan electrode Y1 and the scan electrode Y2 is 2 microseconds, the time difference between the ramp-up waveforms applied to the scan electrode Y2 and the scan electrode Y3 is 8 microseconds, and the time difference between the ramp-up waveforms applied to the scan electrode Y3 and the scan electrode Y4 is also 5 microseconds.

Figure 13A:
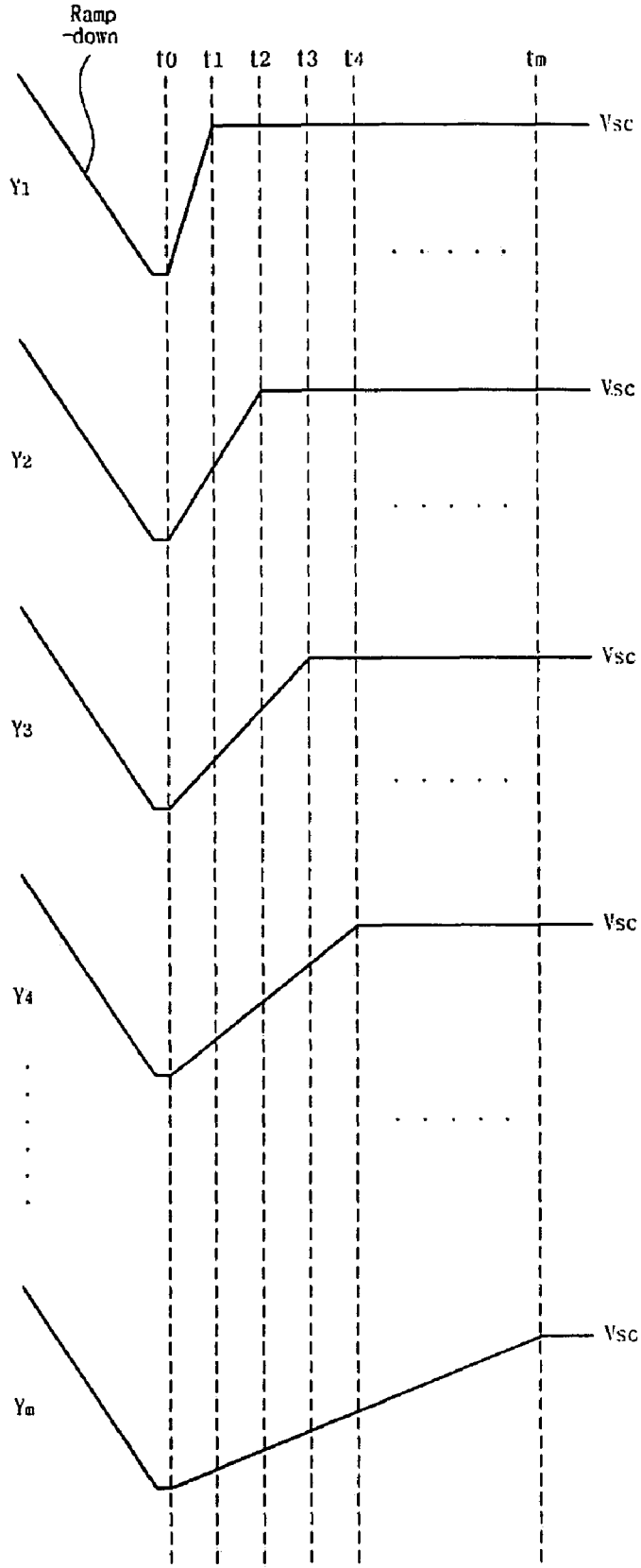
FIG. 13A to 13B are views for explaining a driving method of a plasma display panel according to an example embodiment of the present invention.
Figure 13B:
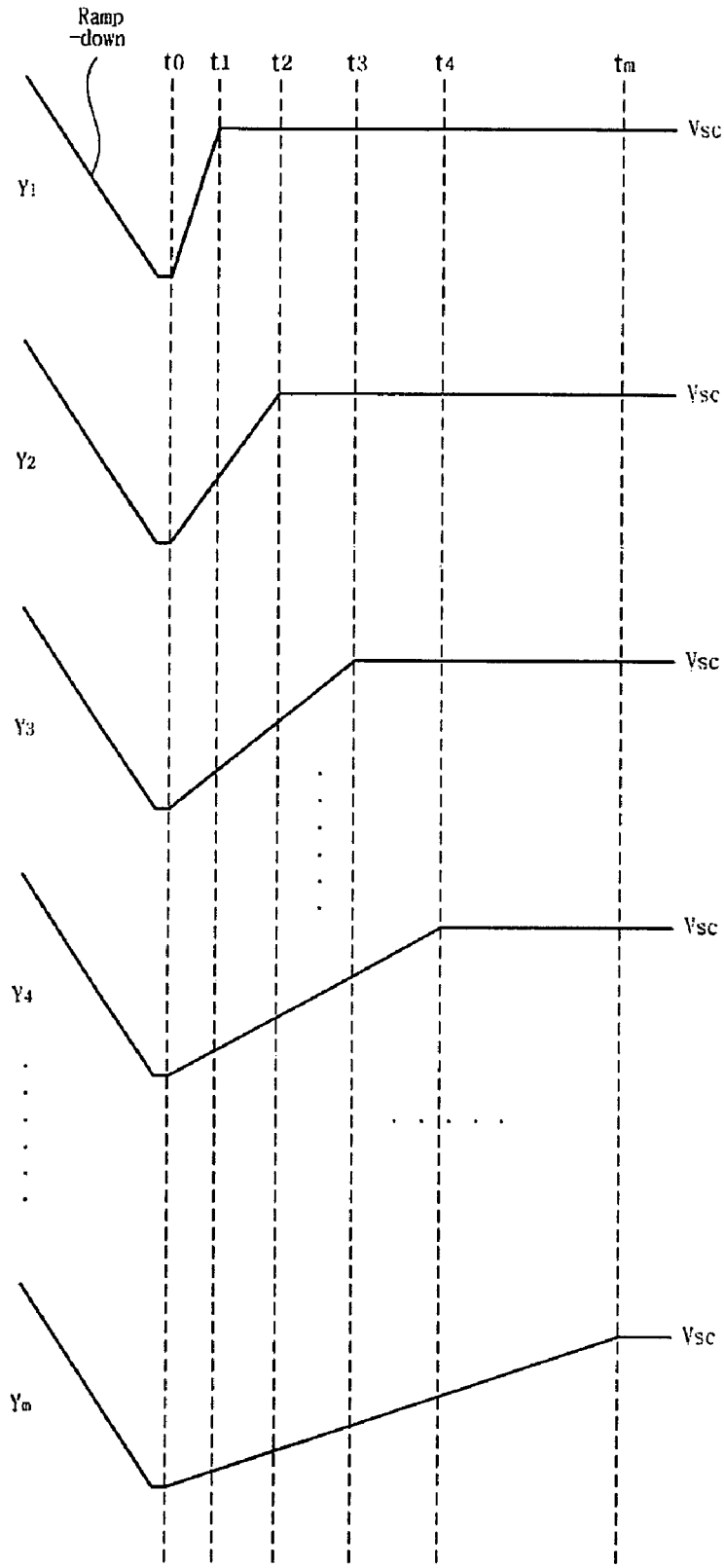

A method of driving a plasma display apparatus by controlling the applying times of ramp-up waveforms applied to the scan electrodes in an address period is shown in FIG. 13A and FIG. 13B. More specifically, FIG. 13 and FIG. 13B are views for explaining a method of the plasma display apparatus (such as shown in FIG. 12) according to an example of the present invention. Other embodiments and configurations are also within the scope of the present invention.

Referring to FIG. 13A and FIG. 13B, the driving method of the plasma display apparatus may control the applying times of the ramp-up waveforms applied to the scan electrodes Y1 to Ym in an address period, in the method of displaying an image composed of a plurality of frames, each including a predetermined subfields, in each of which an address electrode, scan electrodes Y1 to Ym (m is a positive integer) and a sustain electrode are supplied with a predetermined pulses in a reset period, an address period and a sustain period.

For example, the scan electrode Y1 is supplied with a scan reference waveform that begins to rise at t0 and reaches a scan reference voltage Vsc at t1 (i.e., a ramp-up waveform with an applying time of t1−t0), the scan electrode Y2 is supplied with a scan reference waveform that begins to rise at to and reaches a scan reference voltage Vsc at t2 (i.e., a ramp-up waveform with an applying time of t2−t0), the scan electrode Y3 is supplied with a scan reference waveform that begins to rise at t0 and reaches a scan reference voltage Vsc at t3 (i.e., a ramp-up waveform with an applying time of t3−t0), and the scan electrode Y4 is supplied with a scan reference waveform that begins to rise at t0 and reaches a scan reference voltage Vsc at t4 (i.e., a ramp-up waveform with an applying time of t4−t0). That is, the applying times of the ramp-up waveforms applied to the scan electrodes Y1 to Y4 are different from each other.

In FIG. 13A, all the scan electrodes are supplied with scan reference waveforms with different voltage applying times, respectively. Alternatively, only selected scan electrodes may be supplied with the scan reference waveforms with different voltage applying times, respectively. For example, the scan electrode Y1 may be supplied with a scan reference waveform that begins to rise at t0 and reaches a scan reference voltage Vsc at t1 (i.e., a ramp-up waveform with an applying time of t1–t0), and all the other scan electrodes Y2, Y3, Y4 and Ym may be supplied with a scan reference waveform that begins to rise at to and reaches a scan reference voltage Vsc at t2 (i.e., a ramp-up waveform with an applying time of t2–t0).

As shown in FIG. 13A, time differences between two ramp-up waveforms with different applying times may be identical. That is, if the time difference between the applying time of the ramp-up waveform applied to the scan electrode Y1 and the applying time of the ramp-up waveform applied to the scan electrode Y2 is 5 microseconds, the time difference between the applying times of the ramp-up waveforms applied to the scan electrodes Y2 and Y3, respectively is 5 microseconds, and further the time difference between the applying times of the ramp-up waveforms applied to the scan electrodes Y3 and Y4, respectively is 5 microseconds.

Further, the time differences may be set up to be different from each other as shown in FIG. 13B.

In FIG. 13B, the time differences may be different from each other. For example, if the time difference (t2–t1) between the applying time of the ramp-up waveform applied to the scan electrode Y1 and the applying time of the ramp-up waveform applied to the scan electrode Y2 is 5 microseconds, the time difference (t3–t2) between the applying time of the ramp-up waveform applied to the scan electrode Y2 and the applying time of the ramp-up waveform applied to the scan electrode Y3 may be set up to be 7 microseconds, and the time difference (t4–t3) between the applying time of the ramp-up waveform applied to the scan electrode Y3 and the applying time of the ramp-up waveform applied to the scan electrode Y4 may be 10 microseconds.

Accordingly, such a method may reduce the magnitude of noise caused by the ramp-up waveforms applied to the scan electrodes in an address period in the same manner as shown with respect to FIG. 8.

One reason for the noise reduction is that the applying times of the ramp-up waveforms applied to all the scan electrodes Y1 to Ym are not identical, the scan electrodes are divided into a plurality of scan electrode groups, and an applying time of the ramp-up waves applied to one or more scan electrode groups is controlled to be different from an applying time of the ramp-up waves applied to the other scan electrode groups so that coupling that is caused due to capacitance of the panel when the scan reference waveform is applied is reduced, whereby rising noise generated to the waveform applied to the scan electrodes when the scan reference waveform rapidly rises is reduced. As a result, damage to a plasma display panel driving element (i.e., a scan driver IC of a scan driver) may be prevented.

Embodiments of the present invention have been described, and these embodiments may be varied in many ways. Such variations are not to be regarded as a departure from the spirit and scope of the invention, and all such modifications as would be obvious to one skilled in the art are intended to be included within the scope of the following claims. As described above, the plasma display apparatus and the driving method thereof may control a voltage rising time of a scan reference waveform to be applied to a scan electrode in an address period. This may control an applying time of the ramp-up waveform, thereby preventing electrical damage to a driving element of a plasma display panel.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments of the present invention have been described with reference to a number of illustrative embodiments thereof, it should be understood that numerous other modifications and embodiments can be devised by those skilled in the art that will fall within the spirit and scope of the principles of this invention. More particularly, reasonable variations and modifications are possible in the component parts and/or arrangements of the subject combination arrangement within the scope of the foregoing disclosure, the drawings and the appended claims without departing from the spirit of the invention. In addition to variations and modifications in the component parts and/or arrangements, alternative uses will also be apparent to those skilled in the art.

What is claimed is:

1. A driving method of a plasma display apparatus, comprising:

applying a ramp-down waveform to a plurality of scan electrodes, the ramp-down waveform decreasing to a first voltage;

dividing the plurality of scan electrodes into a plurality of scan electrode groups;

applying a ramp-up waveform to the scan electrodes, the ramp-up waveform increasing from the first voltage to a second voltage at a prescribed gradient; and applying a scan pulse to the scan electrodes, the scan pulse decreasing from the second voltage to a third voltage, wherein a time duration of the ramp-up waveform applied to a first one of the scan electrode groups is different from a time duration of the ramp-up waveform applied to a second one of the scan electrode groups, and wherein a prescribed gradient of the ramp-up waveform is less than a gradient of a sustain pulse applied to one of the plurality of scan electrodes in a sustain period.

2. The driving method according to claim 1, wherein applying the ramp-down waveform comprises applying the ramp-down waveform in a reset period.

3. The driving method according to claim 1, wherein applying the ramp-up waveform comprises applying the ramp-up waveform in an address period.

4. The driving method according to claim 1, further comprising maintaining the second voltage for a predetermined period after applying the ramp-up waveform.

5. The driving method according to claim 1, further comprising maintaining the second voltage at the scan electrodes until a first scan pulse is applied to one of the scan electrodes in an address period.

6. The driving method according to claim 1, wherein applying the ramp-up waveform comprises applying the ramp-up waveform during a time period greater than 0 microseconds and not beyond 20 microseconds.

7. The driving method according to claim 1, wherein applying the ramp-up waveform comprises applying the ramp-up waveform during a time period greater than 6 microseconds and not beyond 10 microseconds.

8. The driving method according to claim 1, wherein the third voltage is substantially identical to the first voltage.

9. The driving method according to claim 1, wherein an applying time of the ramp-up waveform applied to a first one of the scan electrodes is different than an applying time of the ramp-up waveform applied to a second one of the scan electrodes.

10. The driving method according to claim 1, wherein the ramp-up waveform is applied at an end point of the ramp-down waveform.

11. The driving method according to claim 1, wherein an applying time of the ramp-up waveform applied to the first one of scan electrode groups is different from an applying time of the ramp-up waveform applied to the second one of the scan electrode groups.

12. The driving method according to claim 11, wherein each of the plurality of scan electrode groups includes a same number of scan electrodes.

13. The driving method according to claim 11, wherein the second one of the scan electrode groups has a different number of scan electrodes than the first one of the scan electrode groups.

14. The driving method according to claim 11, wherein applying a ramp-down waveform comprises applying a plurality of ramp-down waveforms to the scan electrodes of the first one of the scan electrode groups, and each of the ramp-up waveforms applied to the first one of the scan electrode groups has a substantially identical applying time.

15. A driving method of a plasma display apparatus, comprising:

applying a ramp-down waveform to a plurality of scan electrodes, the ramp-down waveform decreasing to a first voltage;

applying a ramp-up waveform to the scan electrodes, the ramp-up waveform increasing from the first voltage to a second voltage at a prescribed gradient; and applying a scan pulse to the scan electrodes, the scan pulse decreasing from the second voltage to a third voltage, wherein the scan electrodes are divided into a plurality of scan electrode groups, and an applying time of the ramp-up waveform applied to a first one of scan electrode groups is different from an applying time of the ramp-up waveform applied to a second one of the scan electrode groups and, wherein a time duration of the ramp-up waveform applied to the first one of the scan electrode groups is different than a time duration of the ramp-up waveform applied to the second one of the scan electrode groups.

16. A plasma display apparatus, comprising:

a plasma display panel having a plurality of scan electrodes; and a scan driver adapted to apply a ramp-down waveform, a ramp-up waveform and a scan pulse to the scan electrodes, the ramp-down waveform decreasing to a first voltage, the ramp-up waveform increasing from the first voltage to a second voltage, and the scan pulse decreasing from the second voltage to a third voltage, wherein the scan electrodes are divided into a plurality of scan electrode groups, and wherein a time duration of the ramp-up waveform applied to a first one of the scan electrode groups is different from a time duration of the ramp-up waveform applied to a second one of the scan electrode groups, and wherein the ramp-up waveform increases from the first voltage to the second voltage at a prescribed gradient, and the prescribed gradient of the ramp-up waveform is less than a gradient of a sustain pulse applied in a sustain period.

17. The plasma display apparatus according to claim 16, wherein the ramp-up waveform is applied at an end point of the ramp-down waveform.

18. The plasma display apparatus according to claim 16, wherein the scan driver is adapted to apply the ramp-down waveform in a reset period.

19. The plasma display apparatus according to claim 16, wherein the scan driver is adapted to apply the ramp-up waveform in an address period.

20. The plasma display apparatus according to claim 16, wherein the scan driver is adapted to maintain the second voltage for a prescribed period after applying the ramp-up waveform.

21. The plasma display apparatus according to claim 16, wherein the scan driver is adapted to maintain the second voltage at the scan electrodes until a first scan pulse is applied to one of the scan electrodes in an address period.

22. The plasma display apparatus according to claim 16, wherein the scan driver is adapted to apply the ramp-up waveform during a time period greater than 0 microseconds and not beyond 20 microseconds.

23. The plasma display apparatus according to claim 16, wherein the scan driver is adapted to apply the ramp-up waveform during a time period greater than 6 microseconds and not beyond 10 microseconds.

24. The plasma display apparatus according to claim 16, wherein the third voltage is substantially identical to the first voltage.

25. The plasma display apparatus according to claim 16, wherein the scan driver is adapted to apply the ramp-up waveform having a first applying time to a first one of the scan electrodes and is adapted to apply another ramp-up waveform having a second applying time to a second one of the scan electrodes, the second applying time being different than the first applying time.

26. The plasma display apparatus according to claim 16, wherein the scan driver is adapted to apply the ramp-up waveform having a first applying time to the first one of the scan electrode groups and is adapted to apply another ramp-up waveform having the second applying time to a second one of the scan electrode groups, the second applying time being different than the first applying time.

27. The plasma display apparatus according to claim 26, wherein each of the plurality of scan electrode groups includes a same number of scan electrodes.

28. The plasma display apparatus according to claim 26, wherein the second one of the scan electrode groups has a different number of scan electrodes than the first one of the scan electrode groups.

29. The plasma display apparatus according to claim 26, wherein the scan driver is adapted to apply a plurality of ramp-down waveforms to the scan electrodes of the first one of the scan electrode groups, and each of the ramp-up waveforms applied to the first one of the scan electrode groups has a substantially identical applying time.

30. A plasma display apparatus, comprising:

a plasma display panel having a plurality of scan electrodes; and a scan driver adapted to apply a ramp-down waveform, a ramp-up waveform and a scan pulse to the scan electrodes, the ramp-down waveform decreasing to a first voltage, the ramp-up waveform increasing from the first voltage to a second voltage, and the scan pulse decreasing from the second voltage to a third voltage, wherein the scan electrodes are divided into a plurality of scan electrode groups, and the scan driver is adapted to apply the ramp-up waveform having a first applying time to a first one of the scan electrode groups and is adapted to apply another ramp-up waveform having a second applying time to a second one of the scan electrode groups, and the second applying time being different than the first applying time and wherein a time duration of the ramp-up waveform applied to the first one of the scan electrode groups is different than a time duration of the ramp-up waveform applied to the second one of the scan electrode groups.

31. A plasma display apparatus, comprising:

a plasma display panel having a plurality of scan electrodes; and a scan driver adapted to apply a ramp-down waveform in a reset period, a ramp-up waveform in an address period and a scan pulse to at least one scan electrode in the address period, the ramp-down waveform decreasing to a first voltage, the ramp-up waveform increasing from the first voltage to a second voltage, and the scan pulse decreasing from the second voltage to a third voltage, wherein a gradient of the ramp-up waveform is less than a gradient of the sustain pulse in a sustain period, wherein the scan electrodes are divided into a plurality of scan electrode groups, and the scan driver is adapted to apply the ramp-up waveform having a first applying time to a first one of the scan electrode groups and is adapted to apply another ramp-up waveform having a second applying time to a second one of the scan electrode groups, and the second applying time is different than the first applying time, and wherein a time duration of the ramp-up waveform applied to the first one of the scan electrode groups is different than a time duration of the ramp-up waveform applied to the second one of the scan electrode groups.

* * * * *